US007703870B2

(12) United States Patent
Yamamoto et al.

(10) Patent No.: US 7,703,870 B2
(45) Date of Patent: Apr. 27, 2010

(54) LIQUID EJECTION APPARATUS

(75) Inventors: Kazunori Yamamoto, Hino (JP); Yasuo Nishi, Hino (JP); Hironobu Iwashita, Hino (JP); Shigeru Nishio, Yamatokoriyama (JP); Kazuhiro Murata, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 0 days.

(21) Appl. No.: 10/583,841

(22) PCT Filed: Nov. 29, 2004

(86) PCT No.: PCT/JP2004/017707

§ 371 (c)(1),
(2), (4) Date: Jun. 22, 2006

(87) PCT Pub. No.: WO2005/063491

PCT Pub. Date: Jul. 14, 2005

(65) Prior Publication Data

US 2007/0146399 A1 Jun. 28, 2007

(30) Foreign Application Priority Data

Dec. 25, 2003 (JP) ..... 2003-430729

(51) Int. Cl.
*B41J 29/38* (2006.01)

(52) U.S. Cl. ..... 347/9; 347/10; 347/11; 347/5; 347/55; 347/57

(58) Field of Classification Search ..... 347/10, 347/47, 44, 5, 9–11, 55, 57
See application file for complete search history.

(56) References Cited

U.S. PATENT DOCUMENTS 5,477,249 A * 12/1995 Hotomi ..... 347/48

(Continued)

FOREIGN PATENT DOCUMENTS

JP 3-246050 A 11/1991

(Continued)

OTHER PUBLICATIONS

Notification Concerning Transmittal of International Preliminary Report on Patentability, Chapter I of the Patent Cooperation Treaty for PCT/JP2004/017707, dated Aug. 23, 2006, and Written Opinion dated Jul. 24, 2006, 5 sheets.

*Primary Examiner*—Matthew Luu
*Assistant Examiner*—Henok Legesse
(74) *Attorney, Agent, or Firm*—Frishauf, Holtz, Goodman & Chick, P.C.

(57) ABSTRACT

A liquid ejection apparatus includes: a liquid ejection head (26) having a nozzle (21) with an inner diameter of 15 μm or less to eject droplets of charged solution onto a substrate; an ejection voltage supply (25) to apply an ejection voltage to a solution inside the nozzle; a convex meniscus generator (40) to form a state in which the solution inside the nozzle rises from the nozzle in a convex shape; and an operation controller (50) to control application of a drive voltage to drive the convex meniscus generator and application of an ejection voltage by the ejection voltage supply so that the drive voltage to the convex meniscus generator is applied in timing overlapped with the application of a pulse voltage as the ejection voltage by the ejection voltage supply.

13 Claims, 16 Drawing Sheets

U.S. PATENT DOCUMENTS 6,017,112 A * 1/2000 Anderson et al. ..... 347/40
6,382,754 B1 * 5/2002 Morikoshi et al. ..... 347/11

FOREIGN PATENT DOCUMENTS

JP 6-262770 A 9/1994
WO WO 03/070381 A1 8/2003

* cited by examiner

FIG.10

| NOZZLE DIAMETER ($\mu$m) | MAXIMUM ELECTRIC FIELD INTENSITY(V/m) | | DEVIATION RATE (%) |
|---|---|---|---|
| | GAP 100 ($\mu$m) | GAP 2000 ($\mu$m) | |
| 0.2 | $2.001 \times 10^9$ | $2.00005 \times 10^9$ | 0.05 |
| 0.4 | $1.001 \times 10^9$ | $1.00005 \times 10^9$ | 0.09 |
| 1 | $0.401002 \times 10^9$ | $0.40005 \times 10^9$ | 0.24 |
| 4 | $0.1010903 \times 10^9$ | $0.100112 \times 10^9$ | 0.97 |
| 8 | $0.0510196 \times 10^9$ | $0.05005 \times 10^9$ | 1.94 |
| 10 | $0.0410563 \times 10^9$ | $0.0400661 \times 10^9$ | 2.47 |
| 15 | $0.0277099 \times 10^9$ | $0.0267170 \times 10^9$ | 3.72 |
| 20 | $0.0210476 \times 10^9$ | $0.0200501 \times 10^9$ | 4.98 |
| 50 | $0.009\ 11111 \times 10^9$ | $0.00805 \times 10^9$ | 13.18 |

| NOZZLE-SUBSTRATE GAP | MENISCUS CONTROL | | |
|---|---|---|---|
| | NOT APPLIED | APPLIED | |
| | | PRIOR ART (DC DRIVE) | PRESENT INVENTION (PULSE DRIVE) |
| 50 (μm) | ◎ | ◎ | ◎ |
| 100 (μm) | X:ATOMIZATION | ○ | ◎ |
| 1000 (μm) | X:ATOMIZATION | ○ | ◎ |

FIG.18

| NOZZLE DIAMETER | DC BIAS VOLTAGE APPLIED | PULSE VOLTAGE APPLIED |
|---|---|---|
| 30 (μm) | NO OOZING | NO OOZING |
| 10 (μm) | OOZING | NO OOZING |
| 1 (μm) | OOZING | NO OOZING |

FIG.19

| NOZZLE DIAMETER | DC BIAS VOLTAGE APPLIED | PULSE VOLTAGE APPLIED |
|---|---|---|
| 30 (μm) | NO CLOGGING | NO CLOGGING |
| 10 (μm) | CLOGGING | NO CLOGGING |
| 1 (μm) | CLOGGING | NO CLOGGING |

LIQUID EJECTION APPARATUS

This application is a U.S. National Phase Application under 35 USC 371 of International Application PCT/JP2004/017707 filed Nov. 29, 2004.

TECHNICAL FIELD

The present invention relates to a liquid ejection apparatus that ejects liquid on a substrate.

BACKGROUND ART

There has been known, as a technique for ejecting droplets, so-called an electrostatic attraction type liquid ejection technique in which solution in an ejection nozzle is charged and then ejected by an electrostatic attracting force given by an electric field produced between the ejection nozzle and a various kinds of substrate that is an object for receiving the droplets.

Among liquid ejection technique in such a field, it has been realized to eject nonconventional minute droplets of making a diameter of an ejection nozzle smaller (less than 20-30 μm) and by using a concentration effect of an electric field produced at the top of rising hemispheric solution formed by surface tension at the top of the nozzle (see, for example, Patent Document 1).

Patent Document 1: WO 03/070381 Pamphlet

DISCLOSURE OF THE INVENTION

Problems to be Solved by the Invention

However, above-described earlier development has a problem as follows.

Smooth ejection of droplets even with use of micro-diameter ejection nozzle, is on the premise that charged solution at the top of the ejection nozzle forms substantially hemispheric meniscus to attain electric-field concentration effect. On the other hand, however, continuous charging of the solution causes electro-wetting effect and makes wettability at the top surface of the ejection nozzle higher so that the solution spreads on the top surface of the nozzle without forming meniscus with a diameter equal to the inner diameter of the ejection nozzle, which causes lowering of ejection performance including ejection failures and variation of droplet diameters.

Further, in a case where ejection is conducted by using an ejection nozzle with extremely small diameter (15 μm or less), it is possible to achieve higher ejection efficiency (lower ejection voltage) by making droplets extremely smaller and electric-field concentration effect. On the other hand, however, making droplets minute causes a voltage limit of Rayleigh fission to be reduced and reach near the voltage possible to eject, thus precise control of the charge quantity is required to suppress atomization of droplets (see FIG. 9).

For this problem, concerning an ejection method that generates a convex meniscus without injection of charge, it can reduce the quantity of charge for ejection, and is effective to suppress the atomization of droplets, thus allows avoidance of precise control for a smaller nozzle.

However, the atomization of droplets tends to occur with expansion of gap between a nozzle and a substrate, and high-speed ejection, and therefore a problem arises in that generation of the convex meniscus is not enough to deal with the requirement of expanding the gap.

Further, since the ejection nozzle has extremely small diameter, in a case where solution including charged particle substances is an ejection object and charging of the solution is continuously conducted, a problem arises in that the particle substances in the solution within the ejection nozzle are excessively concentrated at the nozzle-top side and cause clogging.

Additionally, when the solution continues to be charged, a substrate receiving the droplets may be charged, which makes a potential difference for ejection insufficient resulting in ejection failures, and also makes deposited position accuracy reduced because of minute ejected droplets.

It is therefore a primary object of the invention to solve the problems of: (1) continuous charge of the solution causes electro-wetting effect and makes wettability at the top surface of the nozzle higher so that the solution spreads on the top surface of the nozzle without forming meniscus with a diameter equal to the inner diameter of the nozzle, which causes lowering of ejection performance including ejection failures and variation of droplet diameters; (2) further suppression of atomizing droplets; and (3) the particle substances in the solution within an ejection nozzle are excessively concentrated at the ejection nozzle and causes clogging, and to achieve stable and smooth ejection of minute droplets.

Second object of the invention is to stablize deposited diameters of minute droplets. Third object of the invention is to improve the deposited position accuracy.

DISCLOSURE OF THE INVENTION

The problem is solved by a liquid ejection apparatus including a liquid ejection head having a nozzle with an inner diameter of 15 μm or less for ejecting droplets of charged solution onto a substrate, an ejection voltage supply for applying an ejection voltage to the solution inside the nozzle, a convex meniscus generator for forming a state in which the solution inside the nozzle rises from the nozzle in a convex shape, and an operation controller for controlling application of a drive voltage to drive the convex meniscus generator and application of an ejection voltage by the ejection voltage supply so that the drive voltage to the convex meniscus generator is applied in timing overlapped with the application of a pulse voltage as the ejection voltage by the ejection voltage supply.

Hereinafter, a "nozzle diameter" indicates an inner diameter of a nozzle (inner diameter of a nozzle portion where droplets are ejected) that ejects droplets. Meanwhile, a cross section of a liquid-ejection opening of a nozzle is not limited to a round shape. For example, when the cross section of a liquid-ejection opening has a polygon, star, or other shape, it indicates that a circumscribed circle of the cross-sectional shape has a diameter of 15 μm or less.

A "nozzle radius" indicates ½ length of the nozzle diameter (inner diameter of the nozzle).

A "substrate" in the invention indicates an object that receives droplets of ejected solution, and the material is not particularly limited. For instance, when the above-described structure is applied to an inkjet printer, a recording medium, such as a paper or a sheet, corresponds to the substrate, and when a circuit is formed using conductive paste, a base on which the circuit is to be formed corresponds to the substrate.

In the above-described structure, the substrate surface receiving droplets is arranged opposing to the nozzle.

The solution is supplied inside the liquid ejection head. Under such a state, the operation controller applies both voltages so that the drive voltage to the convex meniscus generator and the ejection voltage to the ejection electrode are overlapped, wherein the convex meniscus generator includes a piezoelectric element, an electrostatic actuator, or a heating resistor.

At this time, the convex meniscus generator forms a state in which the solution rises in the nozzle (convex meniscus). In order to form such convex meniscus, a method in which the pressure inside the nozzle is raised to the extent that a droplet does not overflow the nozzle may be adopted for example.

The ejection voltage does not continuously keep a raised state, but is applied with a pulse voltage that instantaneously rise.

Here, the drive voltage for the convex meniscus generator and the ejection voltage for the ejection electrode are set so that individual application of these voltages cannot eject a droplet and overlapped application of these voltages allows ejection of a droplet. Hereby, when the drive voltage for forming a convex meniscus forms convex meniscus in the nozzle, a droplet of the solution flies from the protruded top of the convex meniscus in a direction perpendicular to the receiving surface of the substrate and forms a dot of the solution on the receiving surface of the substrate.

In the invention, a convex meniscus generator for forming a convex meniscus is provided separately from an ejection voltage supply for applying a voltage to the solution, so that voltage can be lowered compared with a case that an ejection voltage supply alone applies a voltage necessary for forming a meniscus and ejecting a droplet.

Further, because the ejection voltage is a pulse voltage, application time of the ejection voltage applied to the solution is instantaneous, and ejection is performed before the solution spreads around the ejection nozzle caused by the electro-wetting effect.

Additionally, because the application time of the ejection voltage applied to the solution is instantaneous, excessive concentration of particle substances in the solution at the ejection-nozzle side is prevented to thereby reduce clogging.

Furthermore, since application time of the ejection voltage applied to the solution is instantaneous, charging (charging-up) at the substrate side is suppressed, enabling stable ejection and flight in a predetermined direction even for minute droplets.

Further, the convex meniscus generator allows reduction of voltage applied to the ejection electrode and resultantly reduces the charge quantity of the solution, which suppresses atomization of droplets due to the Rayleigh fission limit. Additionally, when applying a pulse voltage to the ejection electrode, adjustment of a pulse width allows the charge quantity of droplet to be optimized. The optimization of the charge quantity allows further suppression of atomization even when the ejection-enabling voltage is close to the Rayleigh fission limit voltage, therefore atomization of droplets can be suppressed even when expanding the gap between a nozzle and a substrate and conducting high-speed ejection.

The operation controller may conduct a control to apply a voltage with reversed polarity to the ejection voltage just before or just after the ejection voltage is applied to the solution inside the nozzle.

That is, when a voltage with reversed polarity to the ejection voltage is applied just before application of the ejection voltage, the electro-wetting effect of the nozzle, the excessive concentration of particle substances in the solution at the ejection-nozzle side, and the effect of charging-up at the substrate side, which are caused by application of the ejection voltage during previous ejection, are cancelled and reduced, and the ejection is performed.

When a voltage with reversed polarity to the ejection voltage is applied just after application of the ejection voltage, the electro-wetting effect of the nozzle, the excessive concentration of particle substances in the solution at the ejection-nozzle side, and the effect of charging-up at the substrate side, which are caused by application of the ejection voltage at the time of ejection, are cancelled and reduced, and the next ejection is performed.

The operation controller may conduct a control to apply the drive voltage to the convex meniscus generator in advance of and simultaneously in timing overlapped with the application of the ejection voltage by the ejection voltage supply.

With this structure, the drive voltage of the convex meniscus generator is applied in advance, and during this application of voltage, the ejection voltage is applied to the ejection electrode.

With this, even when response of the convex meniscus generator is delayed, this delay can be cancelled.

Further, since the ejection voltage is applied to the ejection electrode in a state that a convex meniscus is formed, even when the pulse width of ejection voltage is set narrower, the ejection voltage can be easily synchronized with the drive voltage of the convex meniscus generator.

The head may include a plurality of nozzles and each nozzle may have the convex meniscus generator.

In a case where a head has a plurality of nozzles, when the nozzles are closely disposed to each other to achieve higher integration, crosstalk occurs due to uneven electric-field intensity distribution arising from application of an ejection voltage to each nozzle. This tends to result in unstable ejection, uneven dot diameters, and lowering of deposited accuracy. However, since above-described structure allows reduction of ejection voltage with the convex meniscus generator and results in suppression of the crosstalk, higher integration of multiple nozzles can be achieved.

EFFECT OF THE INVENTION

The liquid ejection apparatus has a convex meniscus generator for forming a convex meniscus separately from an ejection voltage supply that applies an ejection voltage to the solution, so that voltage can be lowered compared with a case that the ejection voltage supply applies a voltage necessary for forming a meniscus and ejecting a droplet. Accordingly, a high-voltage applying circuit and high voltage resistivity is not needed, which allows reduction of the number of parts and improvement of productivity with simplified structure.

Further, since a pulse voltage is applied as the ejection voltage by the ejection voltage supply, an application time of the ejection voltage to the solution becomes instantaneous, which enables ejection before the solution spreads around the nozzle caused by the electro-wetting effect. This allows suppression of ejection failures and droplet diameters to be stabilized.

Additionally, because the application time of the ejection voltage applied to the solution is instantaneous, excessive concentration of particle substances in the solution at the ejection-nozzle side, occurs in the case of continuous application of ejection voltage is prevented. This allows reduction of clogging with particle substances and makes ejection smoother.

Furthermore, since the application time of the ejection voltage applied to the solution is instantaneous, charging-up at the substrate side, which occurs in the case of continuous application of ejection voltage, can be suppressed. This allows stable maintenance of potential difference necessary for ejection and improves ejection stability by reduction of ejection failures. This suppression of charging-up at the substrate side permits stable flying in a predetermined direction even for minute droplets and improves deposition position accuracy.

Further, the convex meniscus generator allows suppression of atomization with respect to the Rayleigh fission limit, and optimization of charge quantity, based on application of pulse voltage to the ejection electrode, allows further suppression of atomization. Accordingly, even when expanding the gap between a nozzle and a substrate and conducting high-speed ejection, atomization of droplets can be suppressed.

When the operation controller controls the ejection voltage supply so that a voltage with reversed polarity to the ejection voltage is applied just after application of the ejection voltage, the electro-wetting effect, the excessive concentration of particle substances in the solution at the nozzle side, and the influence of charging-up, which are caused by application of the ejection voltage, are cancelled, and the next ejection can be maintained at a good state.

Further, when a voltage with reversed polarity to the ejection voltage is applied just before application of the ejection voltage, the electro-wetting effect, the excessive concentration of particle substances in the solution at the nozzle side, and the effect of charging-up, which are caused by application of the ejection voltage at the time of previous ejection, are reduced and eliminated, and the ejection can be maintained to a good state.

In a case where the operation controller applies a drive voltage to the convex meniscus generator in advance to applying ejection voltage by the ejection voltage supply, the influence of the delay in forming a meniscus at a nozzle by driving the convex meniscus generator can be cancelled.

Since the ejection voltage for charging is applied in advance to the solution in a state meniscus is formed, it is easy to synchronize, and resultantly the pulse width of the ejection voltage can be set narrower than that of the drive voltage of the convex meniscus generator. This effectively allows suppressing electro-wetting effect, suppressing concentration of charged particle substances in the solution at the nozzle side, and suppressing charge-up.

When a head has a plurality of nozzles and each nozzle is provided with a convex meniscus generator, the ejection voltage can be reduced to thereby suppress the influence of cross-talk that occur among the nozzles. Accordingly, an ejection head can have nozzles with higher density than conventional one, thereby implementing highly integrated nozzles in an ejection head.

BRIEF DESCRIPTION OF THE DRAWINGS

FIG. 10 is a table showing relationship among nozzle diameters, gaps to an opposing electrode, and maximum electric-field intensity;

FIG. 18 is a table showing a result of comparison test in case of applying a pulse voltage to the ejection electrode and in case of applying a bias voltage, which is observation result for influence from small-diameter nozzles and electro-wetting produced at the top portion of the nozzle; and FIG. 19 is a table showing a result of comparison test in case of applying a pulse voltage to the ejection electrode and in case of applying a bias voltage, which is observation result for influence from small-diameter nozzles and clogging occurring at the top portion of the nozzle.

PREFERRED EMBODIMENT OF THE INVENTION

Overall Structure of Liquid Ejection Apparatus

Figure 1:
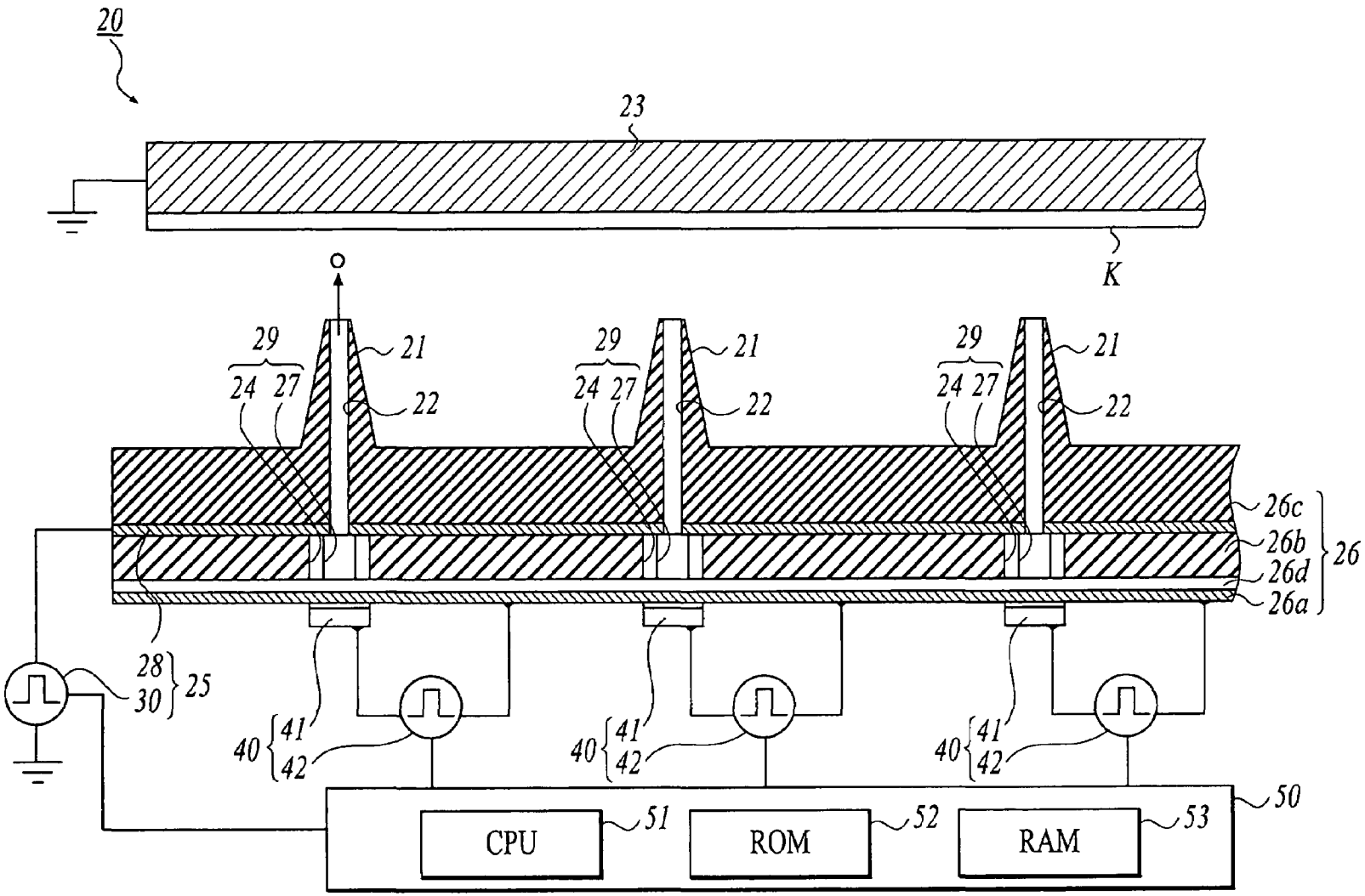
FIG. 1 is a cross-sectional view taken along a nozzle of a liquid ejection apparatus according to a first embodiment.

A description will now be given of a liquid ejection apparatus 20 as an embodiment of the invention with reference to FIGS. 1 to 6. FIG. 1 is a cross-sectional view of the liquid ejection apparatus 20 taken along a nozzle 21 described later.

The liquid ejection apparatus 20 includes the nozzle 21 having an extremely small diameter for ejecting droplets of chargeable solution from the top portion, an opposing electrode 23 having an opposing surface facing the top portion of the nozzle 21 and supporting a substrate K that receives deposited droplets on the opposing surface, a solution supply section 29 to supply the solution to a flow passage 22 inside the nozzle 21, an ejection voltage supply 25 to apply an ejection voltage to the solution inside the nozzle 21, a convex meniscus generator 40 to form a state in which the solution inside the nozzle 21 rises from the top portion of the nozzle 21 in a convex shape, and an operation controller 50 to control application of a drive voltage to the convex meniscus generator 40 and application of the ejection voltage by the ejection voltage supply 25.

Here, an ejection head 26 is provided with a plurality of above-described nozzles 21 arranged on a same plane facing a same direction. With this arrangement, the solution supply section 29 is formed on the ejection head 26 for each nozzle 21, and the convex meniscus generator 40 is also provided on the ejection head 26 for each nozzle 21. On the other hand, only one ejection voltage supply 25 and one opposing electrode 23 are provided for common use for each nozzle 21.

The top portion of the nozzle 21 is shown facing upward and the opposing electrode 23 is arranged above the nozzles 21 in FIG. 1 as a matter of convenience for explanation, however, the nozzles 21 are actually used facing in a horizontal direction or in a lower direction, and more preferably in a vertically downward direction.

Meanwhile, the apparatus has positioning sections, not shown, to move and position the ejection head 26 and the substrate K relatively, and the ejection head 26 and the substrate K are transported, respectively. This allows the droplet ejected from each nozzle 21 on the ejection head 26 to be deposited onto an arbitrary position of the surface of the substrate K.

(Nozzle)

Each nozzle 21 is integrally formed with a nozzle plate 26*c* described later, and mounted perpendicularly to a flat surface of the nozzle plate 26*c*. When droplets are ejected, each nozzle 21 is used facing perpendicularly to the receiving surface (the surface where droplets land) of the substrate K. Further, each nozzle 21 has an inside-nozzle flow passage 22 formed, penetrating through along the center of the nozzle 21 from the top portion.

The nozzle 21 will be explained in more detail. Concerning each nozzle 21, the opening diameter at the top portion and that of the inside-nozzle flow passage 22 are uniform, and these are formed with an extremely small diameter as described above. Specific dimensions of these parts are, for example, as follows: the inner diameter of the inside-nozzle flow passage 22 is set to 15 μm or less, preferably 10 μm or less, more preferably 8 μm or less, much more preferably 4 μm or less, and set to 1 μm in the embodiment. An outer diameter at the top portion of the nozzle 21 is set to 2 μm, a diameter at the root of the nozzle 21 is set to 5 μm, and a height of the nozzle 21 is set to 100 μm. The nozzle is formed in a conically truncated shape, substantially conical shape. The inner diameter of the nozzle is preferably set to more than 0.2 μm. Meanwhile, the height of the nozzle 21 may be 0 μm. That is, the nozzle 21 may be formed at the same height as of the surrounding plane, and the ejection opening may be simply formed at the flat plane, forming the inside-nozzle flow passage 22 passing from the ejection opening to a solution chamber 24. In a case where the height of the nozzle 21 is 0 μm, an end side of the ejection head 26, where the ejection-side opening of the nozzle 21 is provided, is preferably formed of insulating material or provided with an insulating film on the end surface.

Figure 2A:
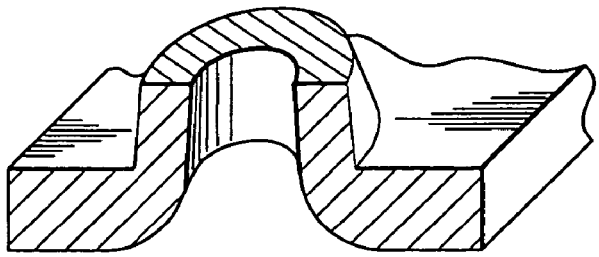
FIG. 2A is a cross-sectional view partially cut to show another example of a flow passage inside the nozzle with a shape, the passage being rounded at a solution-chamber side.
Figure 2B:
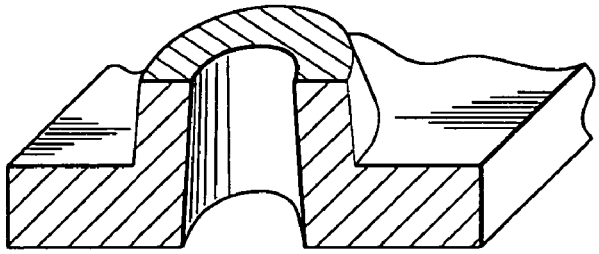
FIG. 2B is a cross-sectional view partially cut to show another example of a flow passage inside the nozzle with a shape, the passage having a tapered circumferential surface at the inside wall.
Figure 2C:
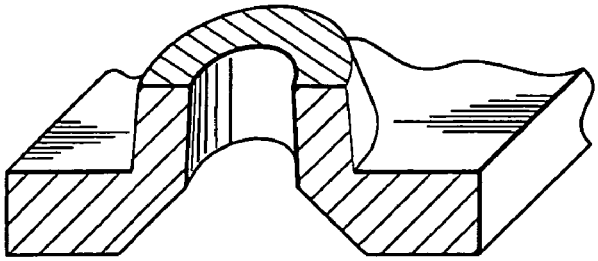
FIG. 2C is cross-sectional view partially cut to show another example of a flow passage inside the nozzle with a shape, the passage having a combination of a tapered circumferential surface and a linear flow passage.

The shape of the inside-nozzle flow passage 22 may not be formed in straight shape with uniform inner diameter as shown in FIG. 1. For example, as shown in FIG. 2A, the inside-nozzle flow passage 22 may be formed with a rounded cross-sectional shape at the end side of a solution chamber 24, which will be explained later. In addition, as shown in FIG. 2B, an inner diameter of the inside-nozzle flow passage 22 at the end of the solution-chamber 24 side may be set larger than that at the ejection-opening side so that the inner surface of the flow passage 22 may be formed in a tapered circumferential shape. Further, as shown in FIG. 2C, the inside-nozzle flow passage 22 may be formed in a shape of tapered circumferential surface only at the end of the solution chamber 24 side and formed in straight shape with uniform inner diameter at the ejection-opening side from the tapered surface.

(Solution Supply Section)

Each solution supply section 29 includes a solution chamber 24 provided inside the liquid ejection head 26 at the proximal end side of the corresponding nozzle 21 and communicating with the inside-nozzle flow passage 22, a supply channel 27 for guiding solution to the solution chamber 24 from an external solution tank (not shown), and a supply pump (not shown) for applying a supply pressure for the solution toward the solution chamber 24.

The supply pump supplies the solution up to the top portion of the nozzle 21 with the supply pressure maintained so that the solution does not appear from the top portion of each nozzle 21 (to an extent that a convex meniscus is not formed) when the convex meniscus generator 40 and the ejection voltage supply 25 are not operated.

The supply pump includes such a case in which a pressure difference is utilized, that depend on positions where the liquid ejection head 26 and a supply tank are arranged, and may have a solution supply passage only without a separate solution supply unit being provided. Although solution supply depends on design of a pump system, the pump basically operates when the solution is supplied to the liquid ejection head 26 at the time of starting, and when the liquid is ejected from the ejection head 26, the solution is supplied according to the ejection of liquid with optimization of pressures derived from capillary, the volume change inside the ejection head 26 by the convex meniscus generator, and the supply pump.

(Ejection Voltage Supply)

The ejection voltage supply 25 includes an ejection electrode 28 for applying an ejection voltage provided at a boundary position between the solution chamber 24 and the inside-nozzle flow passage 22 inside the liquid ejection head 26, and a pulse voltage supply 30 for applying a rapidly rising pulse voltage as an ejection voltage to the ejection electrode 28. The ejection head 26 has a layer that forms nozzles 21, and a layer that forms the solution chambers 24 and the supply channels 27, and a description will be given in detail later. The ejection electrode 28 is provided at the entire boundary of these layers. With this structure, the single ejection electrode 28 contacts the solution within all solution chambers 24, thereby charging the solution guided to all nozzles 21 by application of ejection voltage to the single ejection electrode 28.

The ejection voltage from the pulse voltage supply 30 is set to a value in a range that application of the voltage enables ejection in a state in which a convex meniscus of the solution is formed at the top portion of the nozzle 21 by the convex meniscus generator 40.

The ejection voltage applied by the pulse voltage supply 30 is theoretically obtained by the following equation (1):

$$h\sqrt{\frac{\gamma\pi}{\varepsilon_0 d}} > V > \sqrt{\frac{\gamma k d}{2\varepsilon_0}} \quad (1)$$

where γ: surface tension of solution (N/m), $\in_0$: permittivity of vacuum electric constant (F/m), d: nozzle diameter (m), h: distance between nozzle and substrate (m), k: proportional constant depending on nozzle shape (1.5<k<8.5).

While the above condition gives a theoretical value, an appropriate voltage may be actually obtained based on a test performed with formation and without formation of a convex meniscus.

In the embodiment, the ejection voltage is set to 400 V as an example.

(Liquid Ejection Head)

The liquid ejection head 26 includes a flexible base layer 26*a* positioned at the lowest layer in FIG. 1 and made of flexible material (for example, metal, silicone, resin, or the like), an insulating layer 26*d* made of insulating material and formed over an entire surface of the flexible base layer 26*a*, a flow channel layer 26*b* positioned over the insulating layer for forming supply channels of the solution, and a nozzle plate 26*c* formed over the flow channel layer 26*b*, and the ejection electrode 28 described above is interposed between the flow channel layer 26*b* and the nozzle plate 26*c*.

For the flexible base layer 26*a*, there may be employed flexible material as described above, for example, a metal thin plate. The reason for requiring such flexibility is that later described piezoelectric elements 41, of the convex meniscus generators 40 are provided at the positions on the outer surface of the flexible base layer 26*a* and corresponding to the solution chambers 24 to bend the flexible base layer 26*a*. That is, a predetermined voltage is applied to the piezoelectric element 41 to bend the flexible base layer 26*a* both inward or outward at above-described position, which causes the inner volume of the solution chamber 24 to decrease or increase, so that change of inner pressure enables formation of the convex meniscus of solution at the top portion of the nozzle 21, or enables the solution to be drawn in.

Formed over the flexible base layer 26*a* is a film of resin with high insulation to form the insulating layer 26*d*. Such insulating layer 26*d* is formed thin enough so as not to prevent the flexible base layer 26*a* from being dented, or is formed of resin material easier to be deformed.

Over the insulating layer 26*d*, a soluble resin layer is formed, and then removed, leaving only portions that are given with patterns for forming the supply channels 27 and the solution chambers 24, and then an insulating resin layer is further formed on the removed portions. This insulating resin layer becomes the flow channel layer 26*b*. Over the insulating resin layer, the ejection electrode 28 is formed by plating conductive material (for example, NiP) that spreads in plane, and further over the electrode, an insulating photo-resist resin layer or a parylene layer is formed. This photo-resist resin layer becomes the nozzle plate 26*c*, and therefore this layer is formed with thickness taken into account the height of the nozzle 21. This insulating photo-resist resin layer is lithographed by an electron beam method or femto-second laser to form the nozzle shape. The inside-nozzle flow passages 22 are also formed with laser beam processing. Then, a soluble resin layer along the supply channels 27 and the solution chambers 24 is removed to form the supply channels 27 and the solution chambers 24, thus completing the liquid ejection head 26.

Here, material of the nozzle plate 26*c* and the nozzle 21 may be, specifically, insulating material such as epoxy, PMMA, phenol, soda glass and quarts glass; semiconductor such as Si; or conductor such as Ni, SUS. However, when the nozzle plate 26*c* and the nozzles 21 are formed of conductor, at least a top end surface of the top portion of the nozzle 21, preferably a circumferential surface of the top portion is covered with a film of insulating material. When the nozzle 21 is formed of insulating material, or the surface of the top portion is covered with an insulating film, it is possible to effectively suppress current leakage from the nozzle top portion to the opposing electrode 23 when the ejection voltage is applied to the solution.

In a case where the top end surface of each nozzle 21 has high wettability for solution used regardless of insulating treatment, water repellence treatment is preferably applied to the top end surface, because the convex meniscus formed at the top portion of the nozzle 21 can stably have a radius of curvature closer to the nozzle diameter.

The nozzle plate 26*c* including the nozzles 21 may have water repellency (for example, the nozzle plate 26*c* is formed of resin containing fluorine), or of a water-repellent film having water repellency may be formed at a surface layer of the nozzle 21 (for example, a metal film may be formed on the surface layer of the nozzle plate 26*c*, and a water repellent layer may be formed over the metal film, by eutectoid plating with metal and water repellent resin). Here, the water repellency is a characteristic of repelling liquid. By selecting a water-repellent processing method according to liquid, water repellency of the nozzle plate 26*c* can be controlled. As water-repellent processing methods, electrodeposition of cationic or anionic fluorine-containing resin, topical application of fluoropolymer, silicone resin, poly dimethylsiloxane, sintering method, eutectoid deposition of fluoropolymer, vapor deposition of amorphous alloy plating film, adhesion of organic silicone compounds, fluorine-containing organic silicone compounds, and the like, that are mainly made of poly dimethylsiloxane, which is obtained through plasma polymerization of plasma CVD method, wherein the monomer used is hexamethyl disiloxane, can be mentioned.

(Opposing Electrode)

The opposing electrode 23 has an opposing surface perpendicular to a projecting direction of the nozzle 21, and supports the substrate K along the opposing surface. A distance between the top portion of the nozzle 21 and the opposing electrode 23 is preferably set to 500 μm or less, more preferably to 100 μm or less, and to 100 μm as one example.

The opposing electrode 23 is grounded, and therefore maintains ground potential. Accordingly, an ejected droplet is induced to a side of the opposing electrode 23 by electrostatic force derived from an electric field produced between the top portion of the nozzle 21 and the opposing surface.

In the liquid ejection apparatus 20, since ejection of droplets is performed by enhancing the electric-field intensity with electric-field concentration at the top portion of the nozzle 21 due to making the extremely small nozzle 21, therefore a droplet can be ejected without induction by the opposing electrode 23, but it is preferable to perform induction by electrostatic force between the nozzle 21 and the opposing electrode 23. Additionally, this structure allows the charge of the charged droplet to be released by grounding the opposing electrode 23.

(Convex Meniscus Generator)

The convex meniscus generator 40 includes a piezoelectric element 41 as a piezoelectric transducer disposed on the outer surface (lower surface in FIG. 1) of the flexible base layer 26*a* of the liquid ejection head 26 and at the position corresponding to the solution chamber 24, and a drive voltage supply 42 to apply a rapidly rising drive pulse voltage to deform the piezoelectric element 41.

The piezoelectric element 41 is mounted on the flexible base layer 26*a* so as to deform the flexible base layer 26*a* in a direction of bending inward or outward when the drive pulse voltage is applied.

Figure 3A:
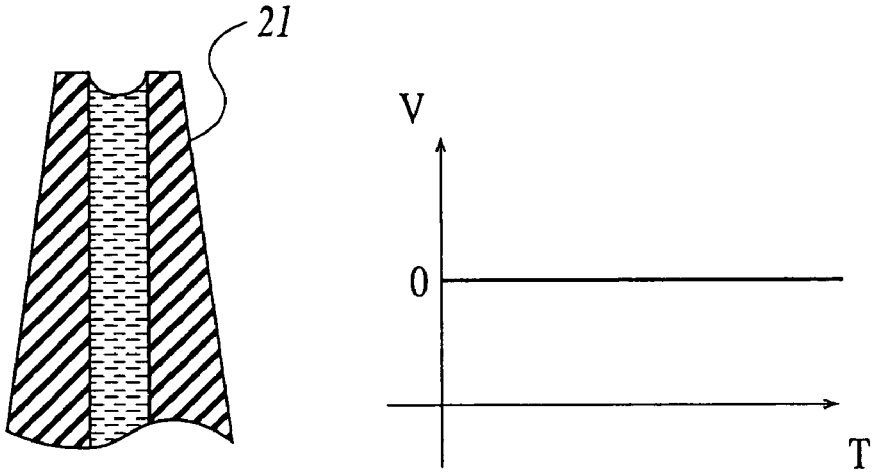
FIG. 3A illustrates a relationship between ejection operation of solution and a voltage applied to the solution, showing a state of non-ejection.
Figure 3B:
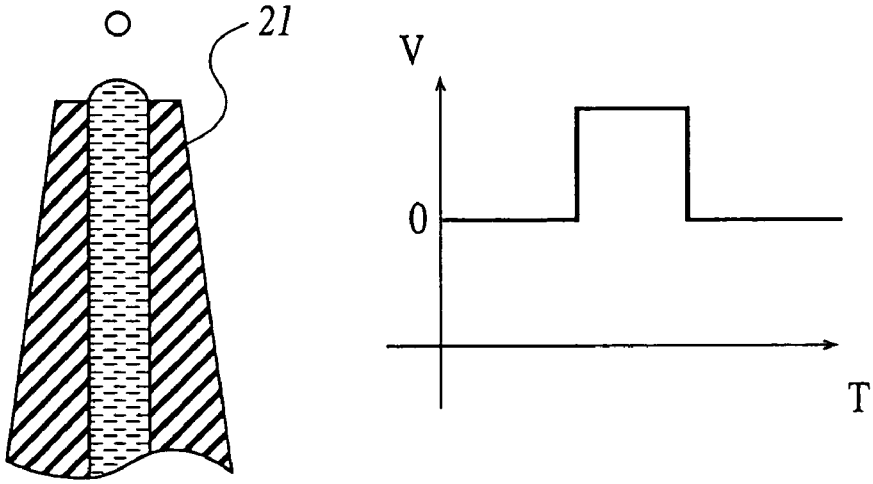
FIG. 3B illustrates a relationship between ejection operation of the solution and a voltage applied to the solution, showing a state of ejection.

The drive voltage supply 42 outputs a drive pulse voltage (for example, 10 V) suitable for the piezoelectric element 41 to properly reduce the volume of the solution chamber 24 so that the solution inside the inside-nozzle flow passage 22 can change from a state without formation of the convex meniscus (see FIG. 3A) to a state with formation of the convex meniscus (see FIG. 3B).

(Solution)

As for example of solution that performs ejection by the liquid ejection apparatus 20, concerning inorganic liquid, water, $COCl_2$, HBr, $HNO_3$, $H_3PO_4$, $H_2SO_4$, $SOCl_2$, $SO_2Cl_2$, $FSO_3H$, and the like can be mentioned. Concerning organic liquid, alcohols such as methanol, n-propanol, isopropanol, n-butanol, 2-methyl-1-propanol, tert-butanol, 4-methyl-2-pentanol, benzyl alcohol, alpha-terpineol, ethylene glycol, glycerin, diethylene glycol, triethylene glycol, phenols such as phenol, o-cresol, m-cresol, p-cresol, ethers such as dioxane, furfural, ethylene glycol dimethyl ether, methyl cellosolve, ethyl cellosolve, butyl cellosolve, ethyl carbitol, butyl carbitol, butyl carbitol acetate, epichlorohidrin, ketones such as acetone, methyl ethyl ketone, 2-methyl-4-pentanone, acetophenone, fatty acids such as formic acid, acetic acid, dichloro acetic acid, trichloro acetic acid, esters such as methyl formate, ethyl formate, methyl acetate, ethyl acetate, n-butyl acetate, isobutyl acetate, 3-methoxy acetate, n-pentyl acetate, ethyl propionate, ethyl lactate, methyl benzoate, diethyl malonate, dimethyl phthalate, diethyl phthalate, diethyl carbonate, ethylene carbonate, propylene carbonate, cellosolve acetate, butyl carbitol acetate, ethyl acetoacetate, methyl cyanoacetate, ethyl cyanoacetate, nitrogen containing compounds such as nitromethane, nitrobenzene, acetonitrile, propionitrile, succinonitrile, valeronitrile, benzonitrile, ethylamine, diethylamine, ethylene diamine, aniline, N-methylaniline, N,N-dimethylaniline, o-toluidine, p-toluidine, piperidine, pyridine, alpha-picoline, 2,6-lutidine, quinoline, propylenediamine, formamide, N-methylformamide, N,N-dimethylformamide, N,N-diethylformamide, acetamide, N-methylacetamide, N-methylpropionamide, N,N,N,N-tetramethylurea, N-methylpyrrolidone, sulfur containing compounds such as dimethyl sulfoxide, sulfolane, hydrocarbon such as benzene, p-cymene, naphthalene, cyclohexyl benzene, cyclohexene, halogenated hydrocarbon such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene (cis-), tetrachloroethylene, 2-chlorobutane, 1-chloro-2-methylpropane, 2-chloro-2-methylpropane, bromomethane, tribromomethane, 1-bromopropane, and the like can be mentioned. Further, at least two of the aforementioned liquids can be mixed and used as the solution.

Additionally, in a case where ejection is performed using a conductive paste that contains a large amount of substance with high electrical conductivity (such as silver powder), an object substance which is to be dissolved or dispersed in the aforementioned solution is not limited, so far as the object substance is not a coarse particle that causes clogging in the nozzle. As for fluorescent material in PDP, CRT, FED, and the like, conventionally known materials can be used without limitation. For example, as for red fluorescent material, $(Y,Gd)BO_3$:Eu, $YO_3$:Eu, and the like, as for green fluorescent material, $Zn_2SiO_4$:Mn, $BaAl_{12}O_{19}$:Mn, (Ba, Sr, Mg)O.$\alpha$-$Al_2O_3$:Mn, and the like, as for blue fluorescent material, $BaMgAl_{14}O_{23}$:Eu, $BaMgAl_{10}O_{17}$:Eu, and the like can be mentioned. In order to firmly adhere the aforementioned object substances onto a record medium, it is preferable to add various kinds of binders. As for binders used, for example, cellulose and its derivatives such as ethyl cellulose, methyl cellulose, cellulose nitrate, cellulose acetate, hydroxyethyl cellulose, and the like; (meth)acryl resins such as alkyd resin, poly-(methacrylicacid), poly-(methylmethacrylate), copolymer of 2-ethylhexylmethacrylate and methacrylic acid, copolymer of laurylmethacrylate and 2-hydroxyethylmethacrylate, and the like and their metal salts; poly-(methacrylamide) resins such as poly-(N-isopropyl acrylamide), poly-(N,N-dimethyl acrylamide), and the like; stylene-based resins such as polystylene, copolymer of acrylonitrile and stylene, copolymer of stylene and maleicacid, copolymer of stylene and isoplene, and the like; stylene-acryl resins such as copolymer of stylene and n-butylmethacrylate and the like; various kinds of saturated and unsaturated polyester resins; polyolephine-based resins such as polypropylene and the like; halogenized polymers such as poly vinyl chloride, poly vinylindene chloride, and the like; vinyl resins such as poly-(vinyl acetate), copolymer of vinyl chloride and vinyl acetate, and the like; polycarbonate resins; epoxy resins; polyurethane resins; polyacetal resins such as poly vinyl formal, poly vinyl butyral, poly vinyl acetal, and the like; polyethylene based resins such as copolymer of ethylene and vinyl acetate, copolymer of ethylene and ethylacrylate, and the like; amide resins such as benzoguanamine and the like; urea resins; melamine resins; poly vinyl alcohol resins and their anion or cation alterations; poly vinyl pyrrolidone and its copolymers; homopolymers, copolymers, and crosslinked alkylene oxides such as poly ethyleneoxide, carboxylized polyethylene oxide, and the like; poly alkylglycols such as poly ethylene glycol, poly propylene glycol, and the like; poly ether polyols; SBR, NBR latex; dextrine; sodium alginate; natural or semisynthetic resins such as gelatine and its delivertives, casein, Abelmoschus manihot, tragacantha gum, pullulan, gum Arabic, locust bean gum, guar gum, pectin, carrageenan, hide glue, albumin, various kinds of starch, corn starch, alimentary yam paste, layer, agar, soy protein, and the like; terpene resin; ketone resin; rosin and rosin ester; poly-(vinyl methyl ether), poly-(ethylene imine), poly-(ethylene sulfonicacid), poly-(vinyl sulfonicacid) can be mentioned. These resins can be used not only as homopolymer, but also be blended as far as they are compatible.

In case of using the liquid ejection apparatus 20 for patterning processing, it can be typically used in display applications. Specifically, the apparatus is applicable to formation of fluorescent material in a plasma display panel, formation of ribs in a plasma display panel, formation of electrodes in a plasma display panel, formation of fluorescent material in a CRT, formation of fluorescent material in an FED (field emission display) panel, formation of ribs in an FED panel, a color filter (RGB coloring layers, black-matrix layer) for liquid crystal display, a spacer for liquid crystal display (pattern corresponding to the black-matrix, dot pattern, etc.), and the like. Here, the rib generally means a barrier wall and is used, for example in the plasma display panel, for separating plasma areas of each color. As for other applications, a microlens; pattern coating of magnetic substance, ferroelectric substance, conductive paste (wiring, antenna), and the like as semiconductor uses; as for graphic uses, normal printing, printing on a special medium (film, cloth, steel plate, and the like), printing on a curved surface; printing on plates for various printing plates; as for processing uses, coating of adhesive, sealing substance, and the like using the present invention; as for biological or medical uses, coating of medical supplies (such as mixing plural small quantity of ingredients), a sample for gene diagnosis, and the like; and the like can be mentioned.

(Operation Controller)

The operation controller 50 has an arithmetic unit including CPU 51, ROM 52, RAM 53, and the like. By inputting predetermined programs to these elements, the controller 50 implements functional structure as described below, and performs operational control to be described later.

The operation controller 50 performs output control of the pulse voltage of the pulse voltage supply 42 in each convex meniscus generator 40 and output control of the pulse voltage of the pulse voltage supply 30 in the ejection voltage supply 25.

When ejecting solution by a power control program stored in the ROM 52, the CPU 51 controls the pulse voltage supply 42 in the target convex meniscus generator 40 in advance to produce a pulse-voltage output state, and thereafter controls the pulse voltage supply 30 in the ejection voltage supply 25 to produce a pulse-voltage output state. At this time, the preceding pulse voltage, as a drive voltage of the convex meniscus generator 40, is so controlled as to overlap with the pulse voltage of the ejection voltage supply 25 (see FIG. 4). Thus, a droplet is ejected in an overlap timing.

The operation controller 50 conducts control so as to output a voltage with reversed polarity just after application of the pulse voltage rising in a rectangular shape which is an ejection voltage of the ejection voltage supply 25. This voltage with reversed polarity has a lower potential than that at the time when the pulse voltage is not applied, and has a waveform falling in a rectangular shape.

(Ejection Operation of Minute Droplets by Liquid Ejection Apparatus)

Figure 4:
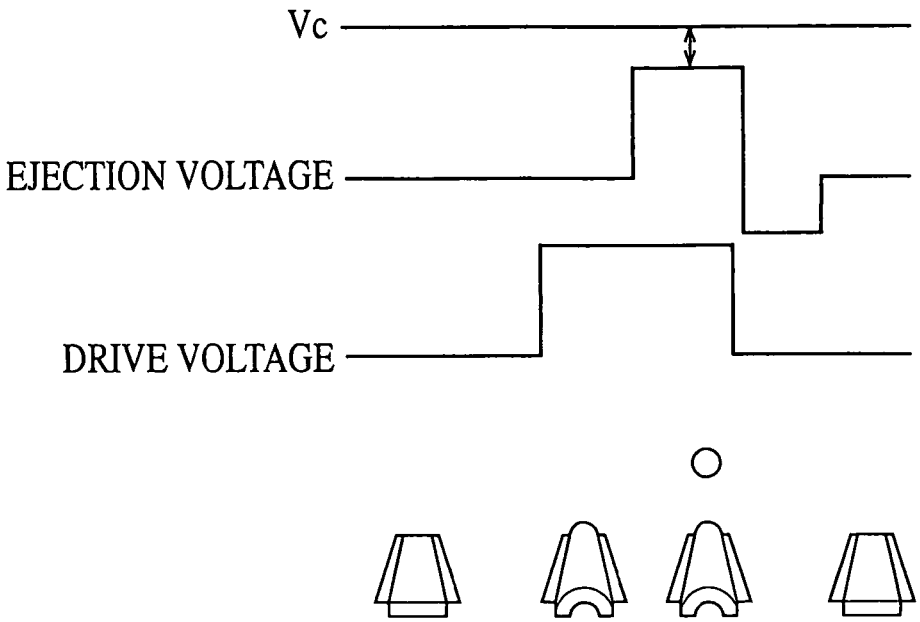
FIG. 4 is a timing chart showing an ejection voltage and a drive voltage of a piezoelectric element.

Operations of the liquid ejection apparatus 20 will be explained referring to FIGS. 1, 3A, 3B and 4. FIG. 3A illustrates the operation of the convex meniscus generator 40 when a drive voltage is not applied, and FIG. 3B illustrates the operation of the convex meniscus generator when a drive voltage is applied. FIG. 4 is a timing chart of an ejection voltage and a drive voltage of a piezoelectric element 41. In FIG. 4, the uppermost part shows a potential of ejection voltage required when the convex meniscus generator 40 is not provided, and the lowermost part shows a state change of solution at the top portion of the nozzle 21, corresponding to application of each voltage.

A supply pump of the solution supply section 29 keeps a state that solution is supplied to each inside-nozzle flow passage 22, solution chamber 24 and nozzle 21. When the operation controller 50 receives a command, for example from the outside, to eject the solution from any one of nozzles 21, the controller 50 first performs application of a pulse voltage as a drive voltage to the piezoelectric element 41 from the pulse voltage supply 42 concerning convex meniscus generator 40 that correspond to the nozzle 21. With this, a state shown in FIG. 3A changes to a convex meniscus forming state shown in FIG. 3B in a manner which the solution is pushed out at the top portion of the nozzle 21.

During this transition process, the operation controller 50 performs application of an ejection voltage as a pulse voltage to the ejection electrode 28 from the pulse voltage supply 30, concerning the ejection voltage supply 25.

As shown in FIG. 4, the drive voltage of the convex meniscus generator 40 and the ejection voltage of the ejection voltage supply 25, which is delayed from the drive voltage, are controlled so as to overlap at the time when both voltages are in risen states. Accordingly, the solution is charged under the convex-meniscus formed state, and a minute droplet flies according to the concentration effect of an electric field produced at the top portion of the convex meniscus.

(Explanation of Effects of Liquid Ejection Apparatus)

The liquid ejection apparatus 20 has the convex meniscus generator 40 separately from the ejection voltage supply 25 that applies an ejection voltage to the solution, so that voltage can be lowered compared with a case in that the ejection voltage supply 25 alone applies a voltage necessary for forming a meniscus and ejecting a droplet. Accordingly, the apparatus does not need a high-voltage applying circuit and resistivity against high voltage, which allows reduction of the number of parts and improvement of productivity with simplified structure.

Figure 5:
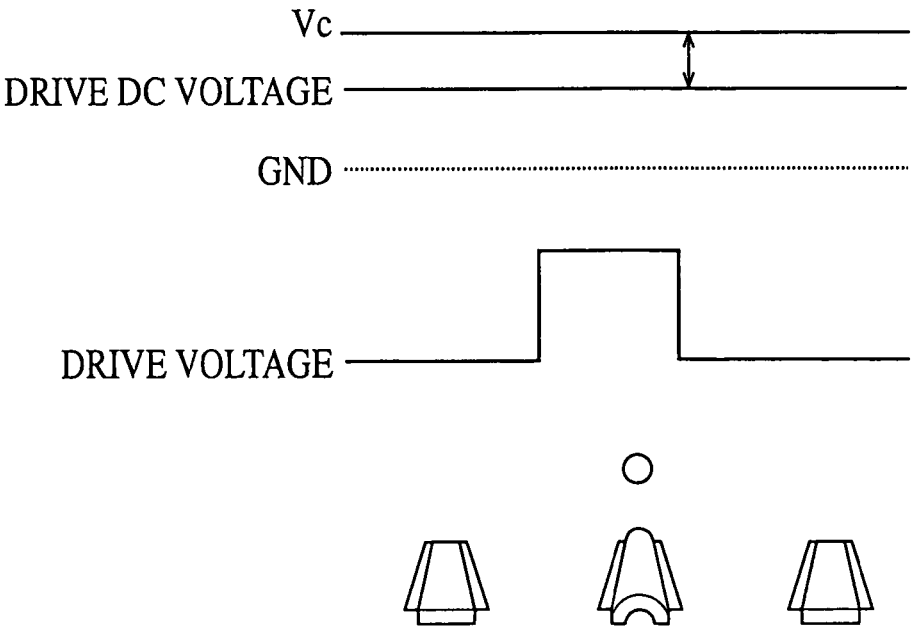
FIG. 5 is a timing chart showing a comparison example in which an ejection voltage (DC voltage) is continuously applied to an ejection electrode.

Further, since the ejection voltage applied to the ejection electrode 28 is a pulse voltage, the time for voltage application can be shortened. FIG. 5 is a timing chart of a comparison example in which an ejection voltage (DC voltage) is continuously applied to the ejection electrode. In the example of FIG. 5, there is continuously applied a DC voltage having a potential equal to that of the pulse voltage applied to the ejection electrode 28 in a risen state.

In this embodiment, time in which ejection voltage is applied to the solution becomes instantaneous in comparison with the comparison example, which enables ejection before the solution spreads around the nozzle 21 due to the electrowetting effect that occurs to charged liquid. This allows suppression of ejection failures and droplet diameters to be stabilized.

Additionally, because the application time of the ejection voltage to the solution is instantaneous, there is prevented excessive concentration of charged particle substances in the solution into the top side of the nozzle 21, which sometimes occurs in the case of continuous application of ejection voltage as in the compared example. This allows reduction of clogging with particle substances and makes ejection smoother.

Furthermore, because time in which ejection voltage is applied to the solution is instantaneous, charging (charging-up) at the side of the substrate K, which occurs in the case of continuous application of ejection voltage can be suppressed, as in the comparison example. This allows stable maintenance of potential difference necessary for ejection and improves ejection stability due to reduction of ejection failures. In addition, since charging-up at the side of the substrate is suppressed stable flying in a predetermined direction even for minute droplets can be achieved and improves deposited position accuracy.

Further, since the operation controller 50 applies a pulse voltage at the convex meniscus generator 40 in advance to timing of applying an ejection voltage by the ejection voltage supply 25, influence on the delay of forming a meniscus at the top portion of the nozzle 21 by driving of the convex meniscus generator 40 can be cancelled.

Since the ejection voltage for charging is applied to the solution with a meniscus formed in advance, it is easy to synchronize, and resultantly the pulse width of the pulse voltage for the ejection electrode can be set narrower than that of drive voltage for the piezoelectric element. This can further contribute to suppression of electro-wetting effect, suppression of concentration of charged particle substances in the solution at the top portion side of the nozzle, and suppression of charge-up.

Since the operation controller 50 applies a voltage with reversed polarity just after the ejection voltage is applied to the ejection electrode 28, there can be cancelled the electro-wetting effect, the excessive concentration of particle substances in the solution at the top portion side of the nozzle, and the influence on charge-up, which are caused by application of the ejection voltage, and the next ejection can be maintained at a good state.

The voltage with reversed polarity is applied just after application of the ejection voltage in the embodiment, but the voltage with reversed polarity may be applied just before application of the ejection voltage. In this case, the electro-wetting effect, the excessive concentration of particle substances in the solution at the top portion side of the nozzle, and the influence on charge-up, which are caused by application of the ejection voltage at the time of previous ejection, are reduced and eliminated, thus the ejection can be maintained at a good state.

Figure 6:
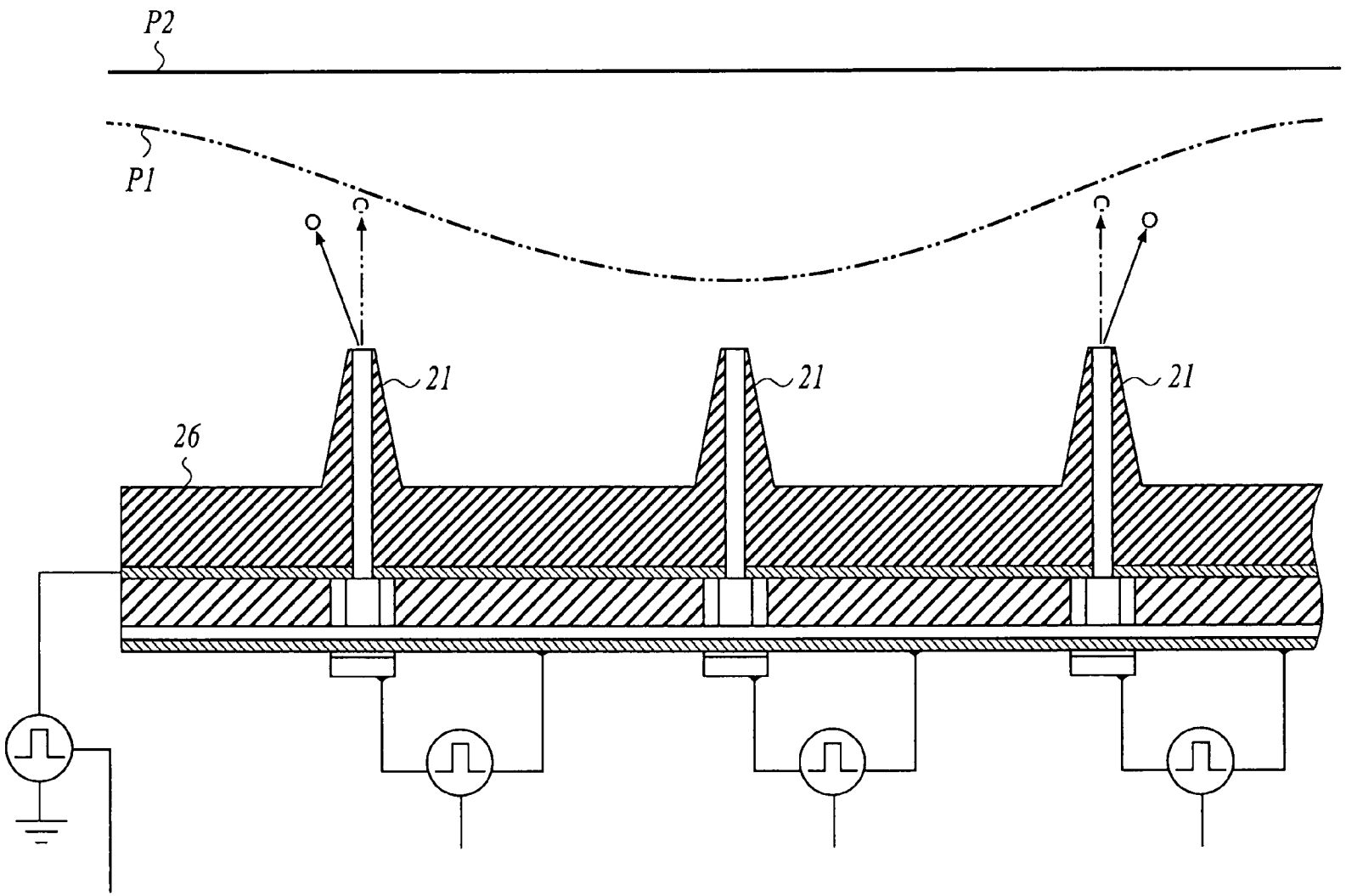
FIG. 6 illustrates influence on an electric-field intensity distribution generated at a front ejection side of an ejection head depending on which the ejection is conducted.

A description will be given for an effect of the convex meniscus generator 40 specific to the liquid ejection head 26 having a plurality of nozzles with reference to FIG. 6. FIG. 6 illustrates influence on an electric-field intensity distribution generated at the ejection side of the ejection head 26, depending on which nozzle 21 conducts ejection. P1 indicates an electric-field intensity distribution in case ejection is conducted from nozzles except the one in center among three nozzles 21, and P2 indicates the case in which all nozzles 21 conduct ejection. Here, the electric-field intensity shown by P1 and P2 becomes higher along going upward in the figure.

When only the center nozzle 21 does not eject, the electric-field intensity distribution becomes low in a center position where ejection is not performed. With such a distribution, each nozzle 21 at both sides has different electric-field intensity at right-and-left sides of the nozzle 21, which causes ejected droplets not to fly straight but to fly spreading in right and left directions. The center nozzle 21, which is not expected to conduct ejection, receives a force to pull out the solution, and the solution may leak from the top of the nozzle 21.

When all nozzles 21 eject, the electric-field intensity becomes uniform, but becomes excessively high compared with the case in which a nozzle 21 that does not conduct ejection, exists in the neighborhood. This makes the diameter of a droplet ejected from each nozzle 21 larger, thereby may cause variation of deposited-droplet diameters.

Such an unbalanced state of electric-field intensity is called cross talk, the unbalanced state being caused by existence of nozzles, that eject and that do not eject, in the ejection head 26 having a plurality of nozzles 21. The influence of the cross talk has been remarkably observed as the ejection voltage becomes higher and the density of nozzles 21 becomes higher. This cross talk generally has been an obstacle to construct an ejection head having highly integrated multi-nozzles with use of electrostatic attraction force.

The liquid ejection apparatus 20 is provided with the convex meniscus generators 40 so that a convex meniscus is formed not by the electrostatic attraction force but by an actuator such as a piezoelectric element, which allows reduction of ejection voltage and resultantly reduces the influence of cross talk. This allows a highly integrated ejection head that has a plurality of nozzles 21 neighboring to each other.

Particularly, the above-described ejection head 26 has the single ejection electrode 28 common to plural nozzles 21, which effectively cancels difference in electric-field intensity distribution produced at each nozzle 21. This further reduces the influence of cross talk, and allows a much higher integration of plural nozzles 21.

(Others)

The convex meniscus generator is not limited to one utilizing a piezoelectric element, and, of course, may employ other means that can hold solution and form a convex meniscus at the top portion of the nozzle 21 by the change of liquid pressure.

Figure 7:
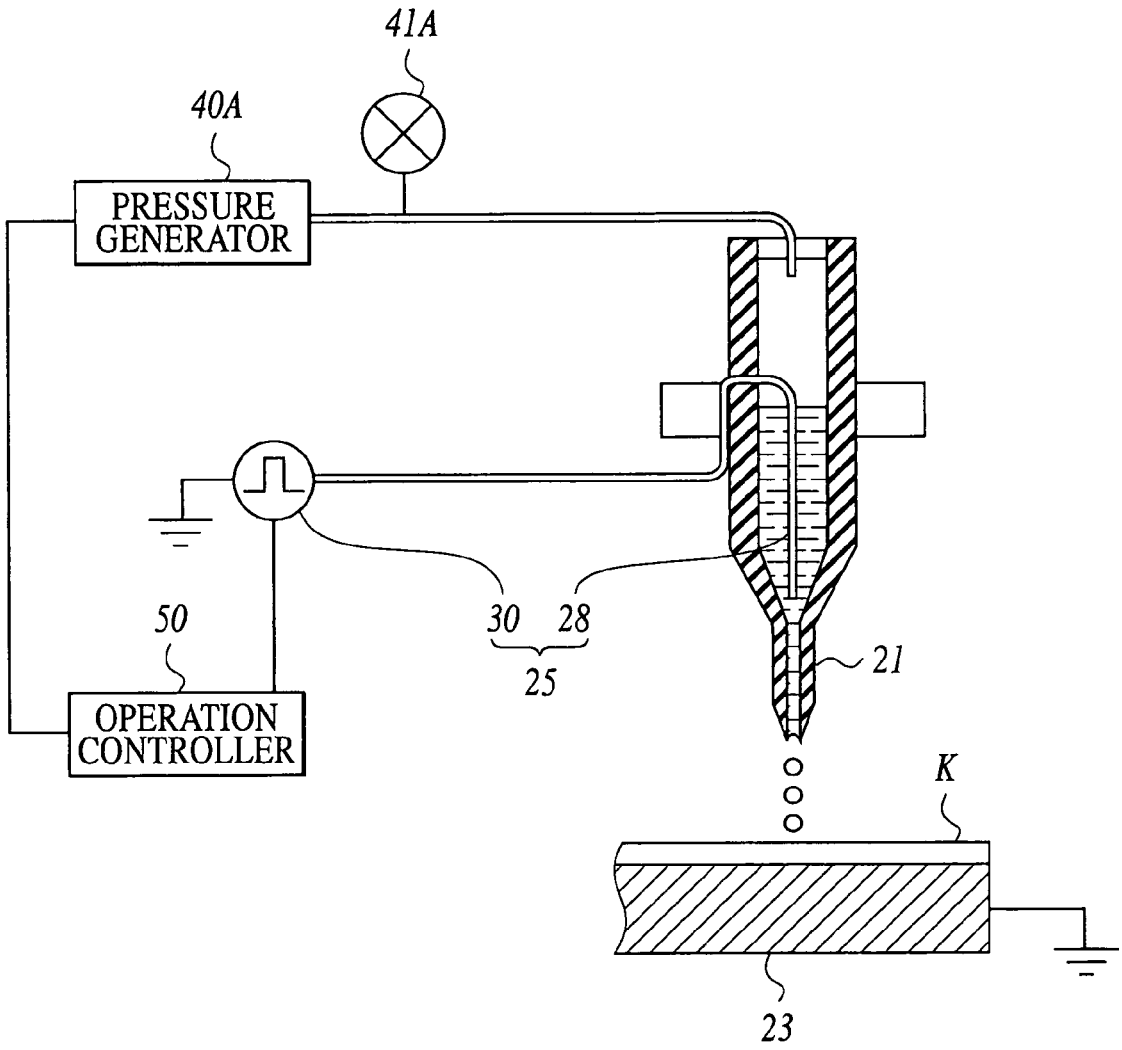
FIG. 7 shows a structure of an example in which a pressure generator for applying ejection air pressure to the solution is employed as a convex meniscus generator.

For instance, as shown in FIG. 7, a structure in which an airtight container having an ejection nozzle and holds solution inside, and a pressure generator 40A is provided as a convex meniscus generator for applying ejection pressure to the solution may be employed. Here, in the ejection head shown in FIG. 7, the same nozzle shape, dimensions of each part, and materials as in the aforementioned ejection head 26 may be employed.

As for a pulse voltage waveform, a rectangular wave is shown as an example in above explanation, but a pulse voltage with other waveforms is arbitrarily applicable. For example, the pulse voltage may have a shape of chopping wave, trapezoidal wave, circular wave, sinusoidal wave, as well as a shape in which pulse has asymmetrical rise and fall waveform, and other shapes. This is also applicable to the following description.

(Theoretical Explanation for Ejection of Minute Droplet Using Micro-Diameter Nozzle)

A description will now be given on theoretical explanation for liquid ejection and a basic example according to the theoretical explanation. Of course, all contents including a nozzle construction, characteristics of material of each part and ejection solution, structures added to the periphery of the nozzle, control conditions relating to ejecting operation and the like, which are described in the theory and the basic example to be explained below, may be applied to the embodiments described above as much as possible.

(Measures for Reducing Ejection Voltage and for Implementing Stable Ejection of Droplet with Minute Quantity)

It has been considered in the past that it is impossible to eject a droplet outside a range defined by the following expressions:

$$d < \frac{\lambda_c}{2} \tag{2}$$

where $\lambda_c$ is a growth wavelength (m) at a solution surface that enables ejection of a droplet from the top portion of a nozzle by electrostatic attraction force, and is obtained by $\lambda_c = 2\pi\gamma h^2 / \epsilon_0 V^2$.

$$d < \frac{\mu\gamma h^2}{\varepsilon_0 V^2} \tag{3}$$

$$V < h\sqrt{\frac{\pi\lambda}{\varepsilon_0 d}} \tag{4}$$

In the invention, role of a nozzle in an electrostatic attraction type inkjet printer is reviewed, and a minute droplet can be formed by using Maxwell force or the like in an area where ejection had not been tried in the past since it was assumed to be impossible.

We have reached to approximate expressions that gives ejection conditions for the measure to realize reduction of driving voltage and ejection of minute quantity, which will be explained below.

A following description is applicable to the liquid ejection apparatus described in the embodiments of the invention.

Figure 8:
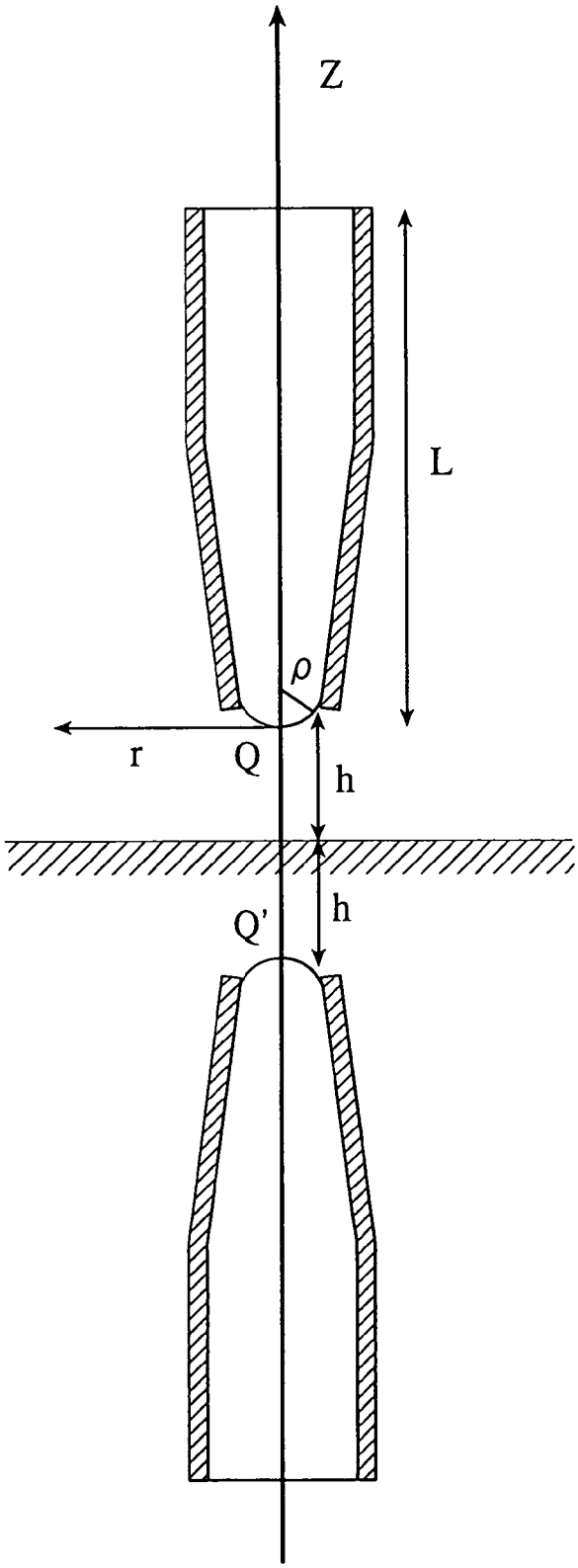
FIG. 8 is a view shown for explaining calculation of electric-field intensity of the nozzle according to the embodiment of the invention.

Here, it is assumed that conductive solution is supplied into a nozzle having an inner diameter d and the nozzle is positioned vertically at the height h from an infinite conductive plane as a substrate. This state is shown in FIG. 8. It is assumed that charge induced at the top portion of the nozzle is concentrated at a hemisphere part of the nozzle top portion and approximately represented by the following equation.

$$Q=2\pi\in_0\alpha Vd \tag{5}$$

where Q: charge induced at the top portion of the nozzle (C), $\in_0$: permittivity of vacuum (F/m), $\in$: permittivity of substrate (F/m), h: distance between the nozzle and the substrate (m), d: inner diameter of the nozzle (m), V: total voltage applied to the nozzle, and a: proportional constant depending on a nozzle shape or the like, which has a value ranging in 1-1.5 and particularly becomes substantially 1.0 in case of d<<h.

In a case where the board as a substrate is a conductive board, it is assumed that reverse charge is induced near the surface to cancel the potential due to the charge Q and thus this state is equivalent to a state that the charge distribution induces mirror charge Q' having a reverse sign at a symmetrical position within the board. When the board is an insulating body, polarization at the surface of the board induces reverse charge at the surface side, and this state is equivalent to a state in which mirror charge Q' determined by permittivity having a reverse sign is similarly induced at a symmetrical position.

Meanwhile, when it is assumed that the radius of curvature at the top portion of a convex meniscus at the nozzle top portion is R (m), electric field intensity at the top portion of the convex meniscus $E_{loc}$ (V/m) is given by $$E_{loc} = \frac{V}{kR} \tag{6}$$

where k: proportional constant, which varies according to a nozzle shape, with a value of approximately 1.5-8.5 and approximately 5 in most cases (P. J. Birdseye and D. A. Smith, Surface Science, 23 (1970) 198-210).

Here, it is assumed that d/2=R for simplification. This corresponds to a state in which surface tension causes the conductive solution to rise in a hemispherical shape at the nozzle top portion with the same radius as the radius of the nozzle.

Balance of pressure applied on the liquid at the nozzle top portion is considered. First of all, electrostatic force $P_e$ is given as below, when a liquid surface area at the nozzle top portion is S $m^2$.

$$P_e = \frac{Q}{S}E_{loc} \approx \frac{Q}{\pi d^2/2}E_{loc} \tag{7}$$

With equations (5), (6) and (7) and taking that $\alpha=1$, $$P_e = \frac{2\varepsilon_0 V}{d/2}\cdot\frac{V}{k\cdot d/2} = \frac{8\varepsilon_0 V^2}{k\cdot d^2} \tag{8}$$

On the other hand, surface tension of the liquid $P_s$ at the nozzle top portion is given by $$P_s = \frac{4\gamma}{d} \tag{9}$$

where $\gamma$ is surface tension (N/m).

Condition for ejecting liquid by the electrostatic force is a condition that the electrostatic force exceeds the surface tension. That is, $$P_e > P_s \tag{10}$$

By using a sufficiently small nozzle diameter d, it is possible to make the electrostatic pressure exceed the surface tension. From this expression, the relationship between V and d is given by $$V > \sqrt{\frac{\gamma kd}{2\varepsilon_0}} \tag{11}$$

This gives the minimum voltage for ejection. From expressions (4) and (11), we obtain $$h\sqrt{\frac{\gamma\pi}{\varepsilon_0 d}} > V > \sqrt{\frac{\gamma kd}{2\varepsilon_0}} \tag{1}$$

This expression gives the operation voltage of the invention.

Figure 9:
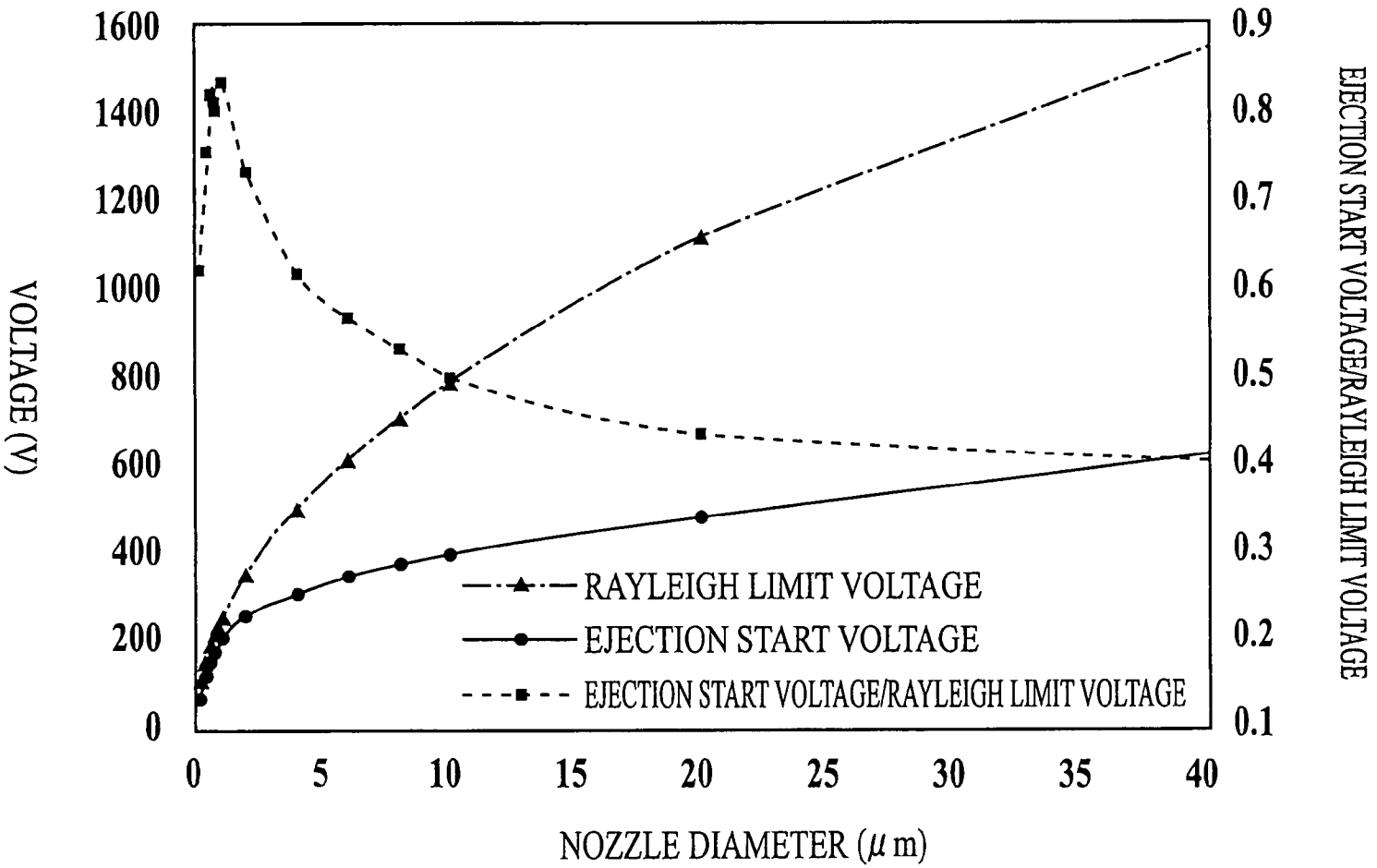
FIG. 9 is a diagram showing a relationship among a nozzle diameter of the nozzle, ejection starting voltage at which a droplet to be ejected at the meniscus portion starts flying, a Rayleigh fission limit voltage of the initial ejected droplet, and a ratio of the ejection starting voltage to the Rayleigh fission limit voltage.

Dependency of the ejection critical voltage $V_c$ for a certain nozzle diameter d is shown in FIG. 9. It became obvious from the figure that the ejection start voltage becomes lower in accordance with the reduction of the nozzle diameter, taking into account field concentration effect with use of a micro-diameter nozzle.

As in a conventional way of thinking an electric field, that is, when only an electric field defined by the voltage applied to a nozzle and the distance between the opposing electrodes is considered, a voltage necessary for ejection increases as the nozzle becomes minute. To the contrary, when focused on local electric-field intensity, it is possible to reduce the ejection voltage by making the nozzle diameter smaller.

Ejection by electrostatic attraction is based on charging a liquid at the end of a nozzle. Charging speed is considered to be approximately a time constant determined by dielectric relaxation:

$$\tau = \in/\sigma \tag{12}$$

where $\in$: permittivity of solution (F/m), $\sigma$: conductivity of solution (S/m). When it is assumed that relative permittivity of the solution is 10 and conductivity is $10^{-6}$ S/m, it is obtained as $\tau = 1.854\times10^{-5}$ sec. Otherwise, when a critical frequency is represented as fc Hz, fc is given by equation $$f_c = \sigma/\in \tag{13}$$

For faster change of electric field than this frequency fc, the nozzle may not be able to respond and ejection is considered to be impossible. For above example, the critical frequency is estimated to be about 10 kHz. At this time, in a case where the nozzle radius is 2 μm and the voltage is a little below 500 V, flow rate G inside the nozzle can be estimated to be $10^{-13}$ $m^3/s$. As for the liquid of above example, ejection is possible at 10 kHz, therefore minimum ejection quantity of about 10 fl (femto-liter, 1 fl: $10^{-15}$ l) per 1 cycle can be achieved.

As shown in FIG. 8, effect of electric-field concentration and effect of mirror-image force induced to the opposing board are features of each embodiment described above. Accordingly, it is not necessary for a board or a board support member to be conductive, or to apply a voltage to the board or board support member, which has been required in the prior art. That is, it is possible in the embodiments to use as a board an insulating glass board, a board using plastic such as polyimide, a ceramics board, a semiconductor board, or the like.

In the embodiments, for the voltage applied to the electrode, either positive or negative voltage may be applicable.

Further, keeping the distance between the nozzle and the substrate to 500 μm or less allows easier ejection of solution. Additionally, feedback control by detection of a nozzle position (not shown) may preferably allow the nozzle position to be constant relative to the substrate.

The substrate may be mounted and held on a conductive or insulative substrate holder.

(Study of Preferable Nozzle Diameter Based on Actual Measurement)

FIG. 10 is a chart showing maximum electric-field intensity under each condition. It has been found from the chart that the distance between the nozzle and the opposing electrode influences the electric-field intensity. That is, it is observed that the electric-field intensity increases when the nozzle diameter is less than ϕ15 μm, between ϕ20 μm and ϕ8 μm, and when the nozzle diameter is ϕ10 μm or less, preferably ϕ8 μm or less, the electric-field intensity concentrates more and change of distance from the opposing electrode seldom affects the electric-field intensity distribution. Accordingly, when the nozzle diameter is 15 μm or less, preferably ϕ10 μm or less, and more preferably ϕ8 μm or less, stable ejection can be attained without being affected by variation of positional accuracy of the opposing electrode and variation of material characteristics and thickness of the substrate.

Figure 11:
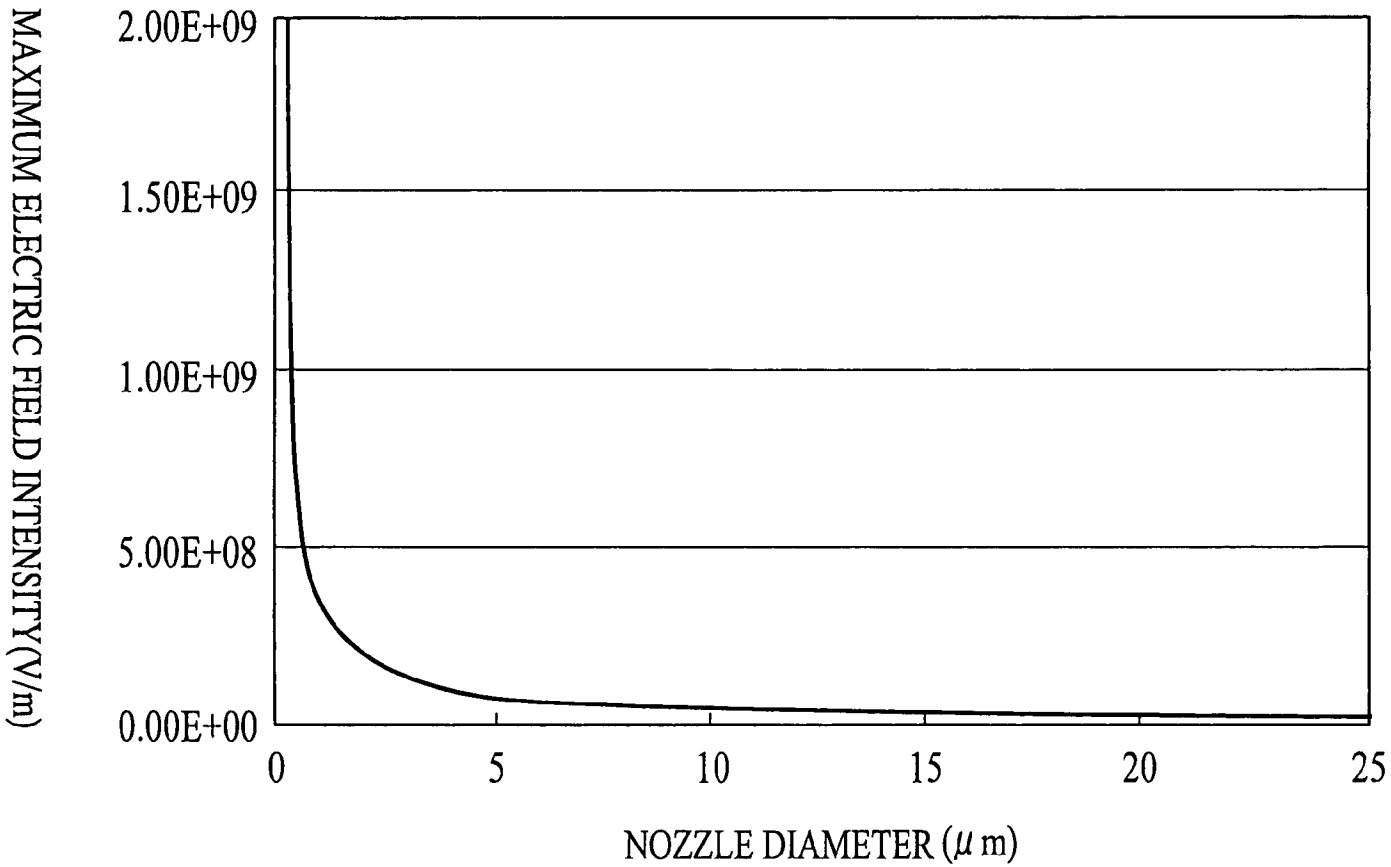
FIG. 11 is a diagram showing a relationship among the nozzle diameter of the nozzle, the maximum electric-field intensity at a meniscus portion in the nozzle, and a strong electric-field area.

Next, FIG. 11 shows the relationship between the nozzle diameter and the maximum electric-field intensity when it is assumed that the liquid surface is at the top of the nozzle.

It has been found from FIG. 11 that, when the nozzle diameter is ϕ4 μm or less, electric field concentration becomes extremely large and the maximum field intensity can be made higher. This allows the initial ejection speed of solution to be faster so that flying stability of a droplet can be increased and ejection response can be improved since charge moving speed at the nozzle top increases.

Next, a description will be given for the maximum charge amount chargeable to an ejected droplet. The maximum charge amount chargeable to a droplet is shown by the following equation, taking into account the Rayleigh fission (the Rayleigh fission limit) of a droplet:

$$q = 8\times\pi\times\sqrt{\varepsilon_0\times\gamma\times\frac{d_0^3}{8}} \tag{14}$$

where q is the amount of charge (C) giving the Rayleigh fission limit, $\in_0$ is the permittivity of vacuum (F/m), $\gamma$ is surface tension of solution (N/m), and $d_0$ is a droplet diameter (m).

As the charge amount q obtained by equation (14) becomes close to the Rayleigh fission limit, electrostatic force becomes stronger even under the same electric-field intensity and ejection stability is improved. However, when the charge amount q is too close to the Rayleigh fission limit, solution may be atomized at the liquid ejection opening of the nozzle to result in unstable ejection, to the contrary.

FIG. 9 shows the relationship among the nozzle diameter, ejection starting voltage at which a droplet to be ejected from the top portion of the nozzle starts flying, the voltage of initial ejected droplet at Rayleigh fission limit, and a ratio of the ejection start voltage to the Rayleigh limit voltage.

It has been found from the graph of FIG. 9 that, when the nozzle diameter is in the range from ϕ0.2 cm to ϕ4 μm, the ratio of the ejection starting voltage to the Rayleigh limit voltage is over 0.6, and relatively large charge can be given to droplets even at low ejection voltage, resulting in good charging efficiency of droplets and stable ejection within the range.

Figure 12A:
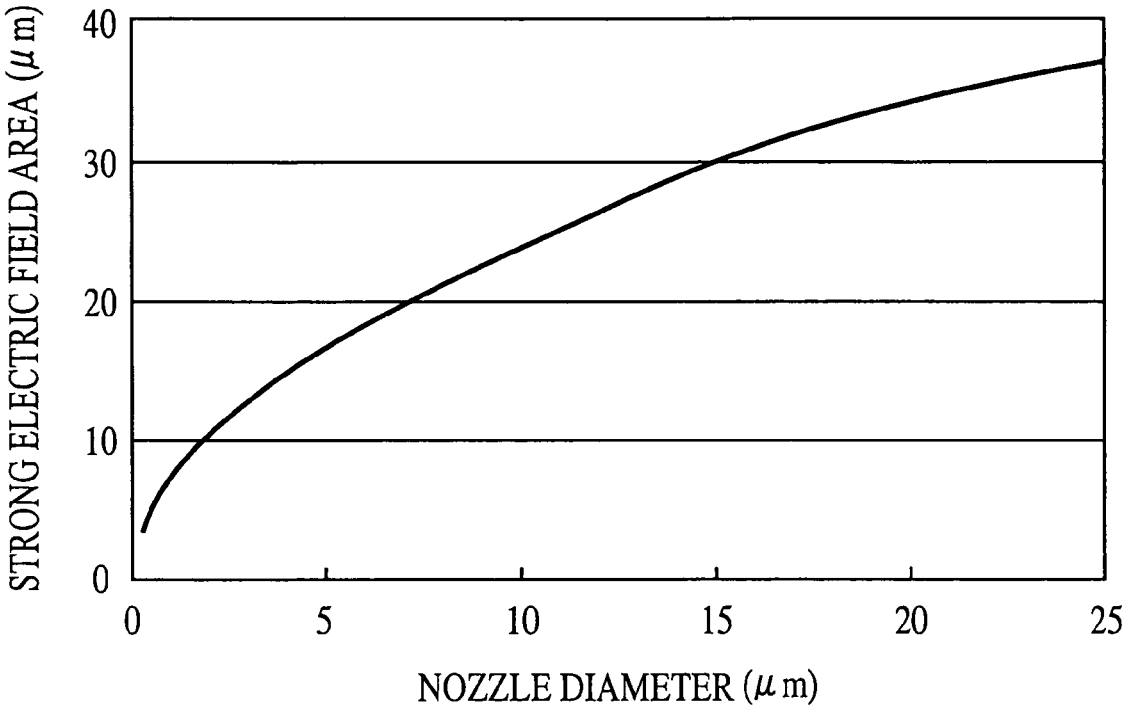
FIG. 12A is a graph showing a relationship between the nozzle diameter and a strong electric field area at the top portion of the nozzle.
Figure 12B:
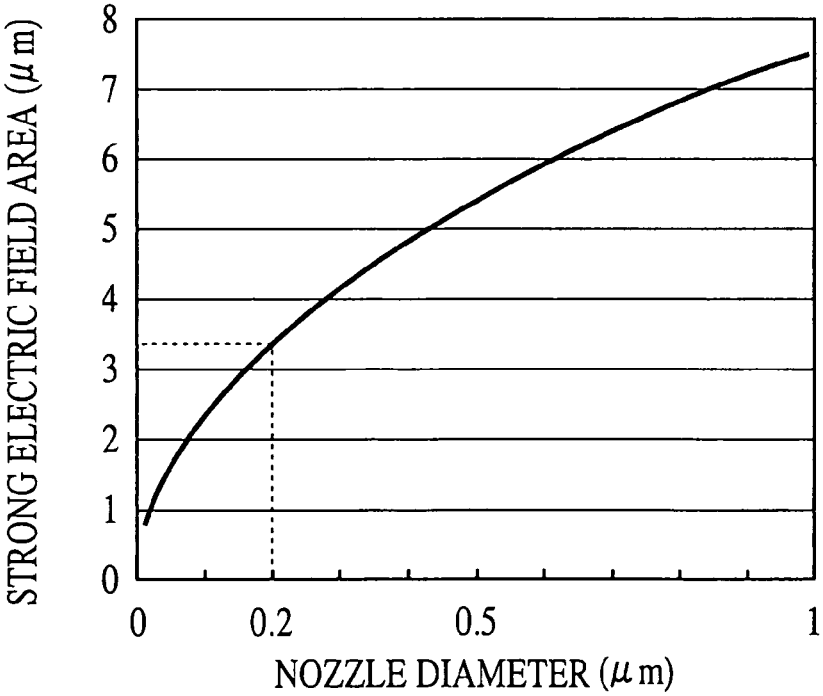
FIG. 12B is an enlarged view showing an area corresponding to the small nozzle diameters in FIG. 12A.

For example, FIGS. 12A and 12B are graphs showing the relationship between the nozzle diameter and a strong electric field ($1\times10^6$ V/m or more) area at the top portion of the nozzle, the area being indicated by the distance from the center of the nozzle. The graphs show that the area of electric-field concentration becomes extremely narrow as the nozzle diameter becomes 0.2 μm or less. This means that an ejecting droplet cannot receive enough energy for acceleration and flying stability is reduced. Therefore, it is preferable to set the nozzle diameter to larger than 0.2 μm.

(Test for Evaluating Ejection Voltage Reducing Effect by Convex Meniscus Generator)

Figure 13:
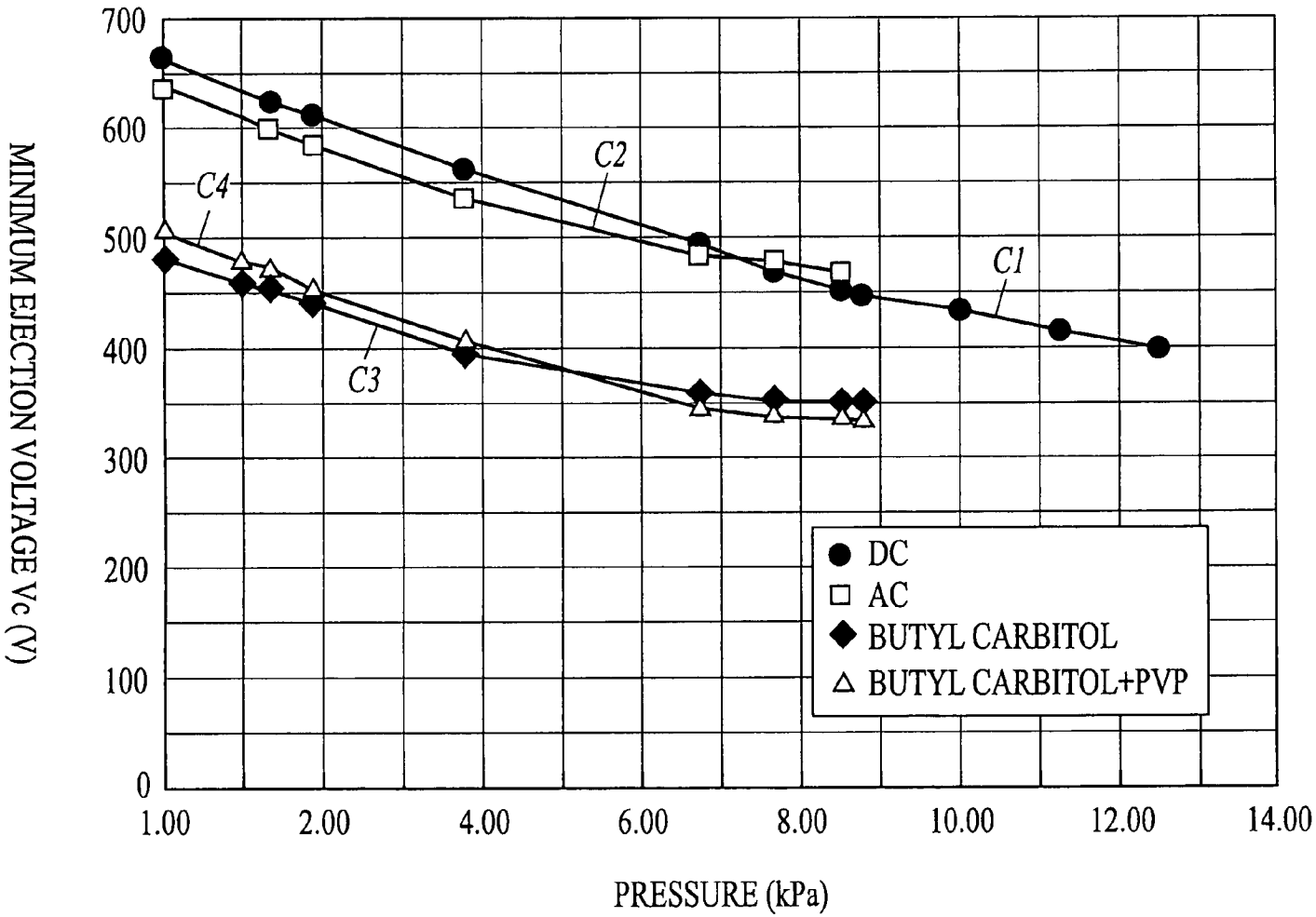
FIG. 13 is a diagram showing a relationship between air pressure and minimum ejection voltage in a case where the convex meniscus generator that applies the ejection air pressure to the nozzle is employed.

FIG. 13 is a diagram indicating the air pressure as abscissa and the minimum ejection voltage as ordinate when an air pressure is applied during a certain time for meniscus control in the liquid ejection apparatus shown in FIG. 7, the apparatus using the pressure generator as a convex meniscus generator for applying the ejection air pressure to the nozzle.

A curve C1 shows a case in which a DC voltage (continuous bias voltage) is applied to triethylene glycol, and a curve C2 shows a case in which an AC voltage (pulse voltage) is applied. A curve C3 shows a case in which an AC voltage (pulse voltage) is applied to butyl carbitol, and C4 shows a case in which an AC voltage (pulse voltage) is applied to butyl carbitol+PVP (butyl carbitol solution containing 10 wt % of polyvinyl phenol).

As shown in these curves C1-C4, as the air pressure for forming a meniscus becomes larger, the ejection voltage tends to be reduced, thus an effect of reducing the ejection voltage by formation of meniscus is observed.

(Test for Evaluating Ejection Voltage Reducing Effect by Convex Meniscus Generator)

Figure 14A:
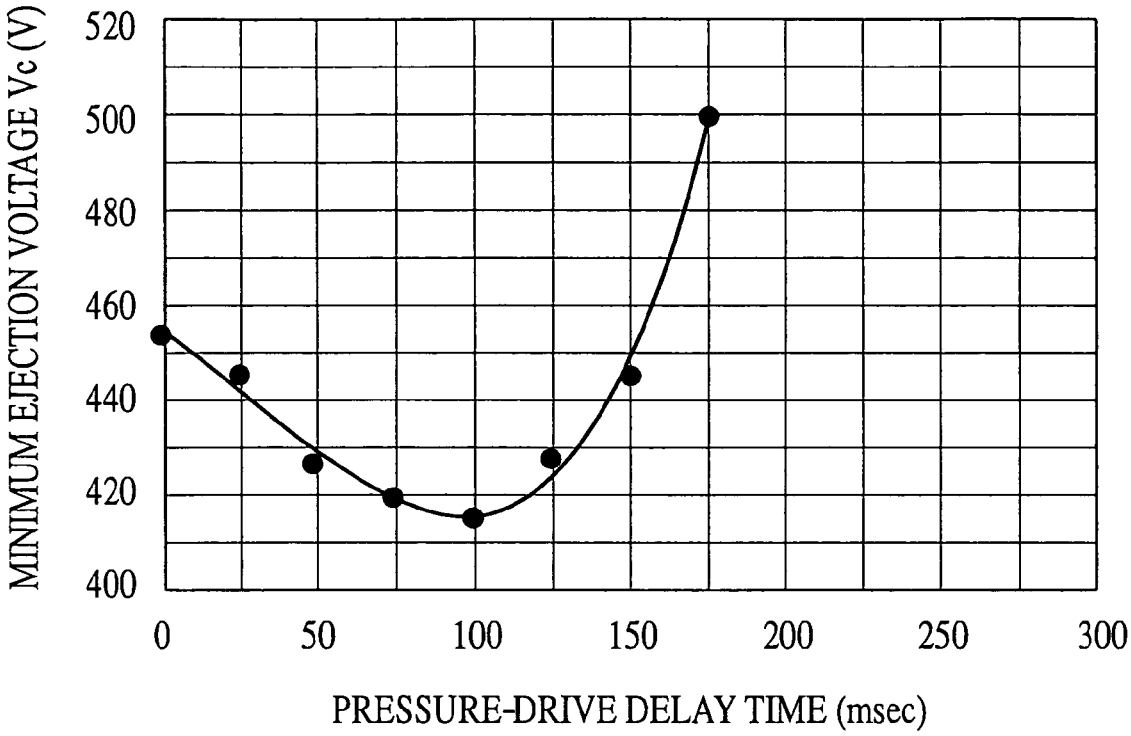
FIG. 14A is a diagram showing a relationship between drive-delay time and voltage value of voltage applied to the ejection electrode at respective times.
Figure 14B:
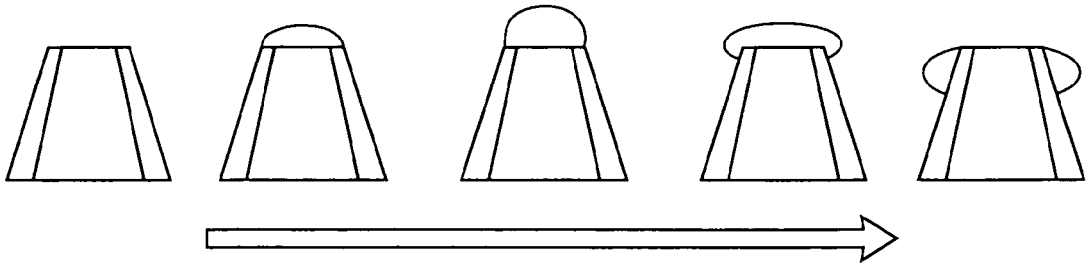
FIG. 14B illustrates a generation state of meniscus produced at the top of the nozzle that change as the time elapses from application of the drive voltage for generating the air pressure.

FIG. 14A is a diagram showing the relationship between drive-delay time and voltage applied to the ejection electrode at respective times in the liquid ejection apparatus shown in FIG. 7 that uses a pressure generator as a convex meniscus generator for applying the ejection air pressure to the nozzle, the drive-delay time being an interval term, from the application of a drive voltage to generate an air pressure for meniscus control, to the application of an ejection voltage to the ejection electrode. FIG. 14B illustrates the state transition for generating a meniscus produced at the top portion of the nozzle as along with the time elapse from application of the drive voltage for generating the air pressure. FIG. 14B shows the states that change from left to right as along with the elongation with time elapse from application of the drive voltage.

As shown in FIG. 14A, tendency was observed in that the minimum ejection voltage becomes lower according to the increase of the drive-delay time from 0 to 100 msec, and that the minimum ejection voltage increases again after 100 msec of the drive-delay time extends.

On the other hand, it is observed in FIG. 14B that, as the time elapsed from application of the drive voltage becomes larger, a projection amount of meniscus becomes larger gradually and the solution finally overflows from the top portion of the nozzle, and that the meniscus formed at 100 ms after the application of drive voltage has the smallest radius of curvature as shown at a third picture from the left in FIG. 14B.

That is, it has been observed that, by making the drive-delay time coincident with the timing when the meniscus has the smallest radius of curvature, the drive-delay time can be optimized to allow the minimum ejection voltage to be effectively reduced.

(Test for Evaluating Effect of Suppressing Atomization Caused by Rayleigh Fission Limit by Convex Meniscus Generator)

According to the graph shown in FIG. 9, the voltage for ejecting liquid without atomization (the Rayleigh fission limit voltage) becomes closer to the ejection start voltage as the nozzle diameter becomes smaller to eject minute droplets. Therefore, it becomes difficult to stably eject without atomization in an area of ejecting minute droplets.

On the other hand, it is understood from equation (14) that smaller quantity of charge q makes atomization difficult. When a voltage is applied in the state that a meniscus is formed at the nozzle top portion with use of the convex meniscus generator of the invention, it is possible to reduce the charge q as an ejection condition from equation (7) (indicated as Q in equation (7)) due to electric-field concentration effect, compared with a case in which ejection is performed by electric field only. Particularly, application of a pulse voltage with an appropriate width to the ejection electrode allows the charge necessary for ejection to be close to the minimum charge amount, without injection of excessive charge to a droplet, thereby the charge quantity can be easily optimized.

This makes it possible to suppress the atomization with respect to the Rayleigh fission limit using the convex meniscus generator, and to suppress the atomization by optimizing the charge quantity based on the application of a pulse voltage to the ejection electrode.

When a nozzle-substrate gap (Gap) is made larger, the charge necessary for ejection becomes larger to cause a tendency to generate atomization. Here, the electric field E (V/m) at the nozzle top portion is given by $$E=f(\text{Gap},V,d)$$

where d is an inner diameter at the nozzle top portion. That is, the electric field E at the nozzle top portion is presented by a function of the nozzle-substrate gap, the applied voltage, and the diameter at the nozzle top. In addition, the charge Q (C) to be induced at the nozzle top portion needs to satisfy the following expression:

$$Q>2\gamma\pi d/E$$

where γ (N/m) is a surface tension of solution.

Figures 15, 16:
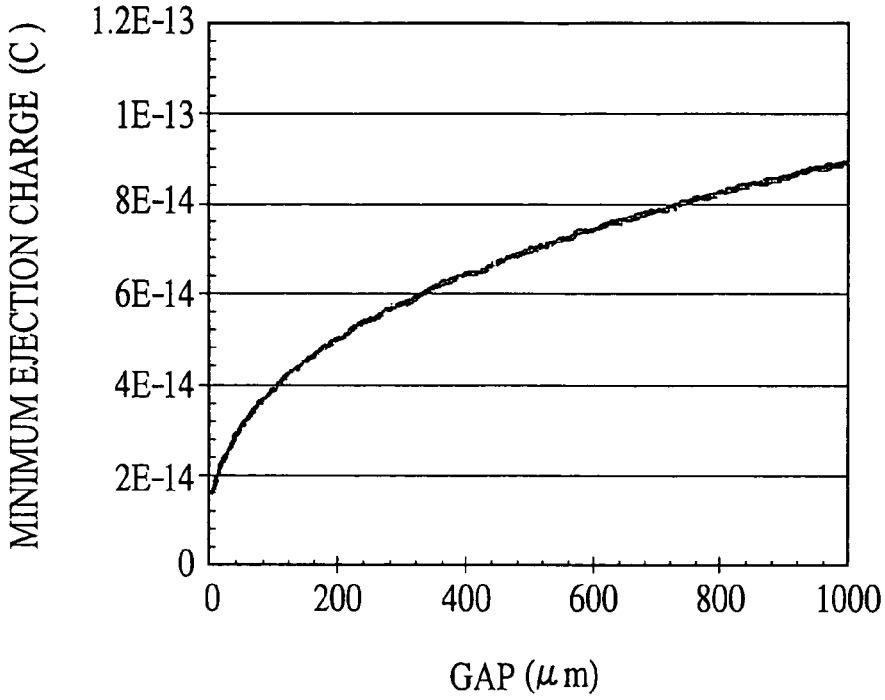
FIG. 15 is a diagram showing a relationship between the gap of nozzle-substrate and the minimum ejection charge quantity.
FIG. 16 is a table showing a result of comparison test that shows influence on atomization of droplets associated with the gap of nozzle-substrate concerning the present invention is compared with compared examples.

FIG. 15 is a graph showing a relationship between the nozzle-substrate gap and the charge quantity to be induced at the nozzle top portion when a nozzle diameter is 10 μm, and an ejection voltage is 1000 V. As understood from FIG. 15, the larger the nozzle-substrate gap, the higher the minimum ejection charge quantity, which causes a tendency for a droplet to exceed the Rayleigh fission limit and be atomized.

Next, a test for evaluating an effect of suppressing atomization of the present invention, for the larger nozzle-substrate gap is carried out, and a test result will be explained.

FIG. 16 shows the result of comparison test under three kinds of conditions in the aforementioned liquid ejection apparatus shown in FIG. 7, the apparatus using the pressure generator as a convex meniscus generator for applying an ejection air pressure to a nozzle, the three kinds of conditions including (1) applying a pulse voltage to the ejection electrode, (2) applying a DC voltage to the ejection electrode, and (3) using the ejection apparatus without the convex meniscus generator. Gaps are changed to three levels of 50 μm, 100 μm and 1000 μm, and it was observed whether atomization (scattering) of solution occured under continuous ejection.

In FIG. 16, ◎ (double circle) indicates a case that scattering of solution was not found even under continuous ejection, ○ (single circle) indicates a case that little scattering of solution was found under continuous ejection, and X indicates a case that atomization was found under continuous ejection.

According to the test, it was possible to eject without scattering in any cases for 500 μm Gap, but with the Gap over 100 μm, it became impossible to conduct ejection due to atomization, concerning the ejection apparatus without the convex meniscus generator. Concerning the ejection apparatus having the convex meniscus generator and applied with a DC voltage to the ejection electrode, ejection was possible, but a little scattering of solution was observed when the Gap exceeded 100 μm.

In the ejection apparatus having the convex meniscus generator and applied with a pulse voltage to the ejection electrode, a good ejection state was observed without scattering of solution even when the Gap was expanded up to 1000 μm.

From this, the following result has been observed: the convex meniscus generator has an effect of suppressing atomization of solution, and further, application of a pulse voltage allows an effect of further suppressing atomization of solution by optimizing electric charge quantity, and the atomization can be suppressed even under the environment with expanded Gap.

(Test [1] for Evaluating Effect of Pulse Voltage as Ejection Voltage)

Figure 17:
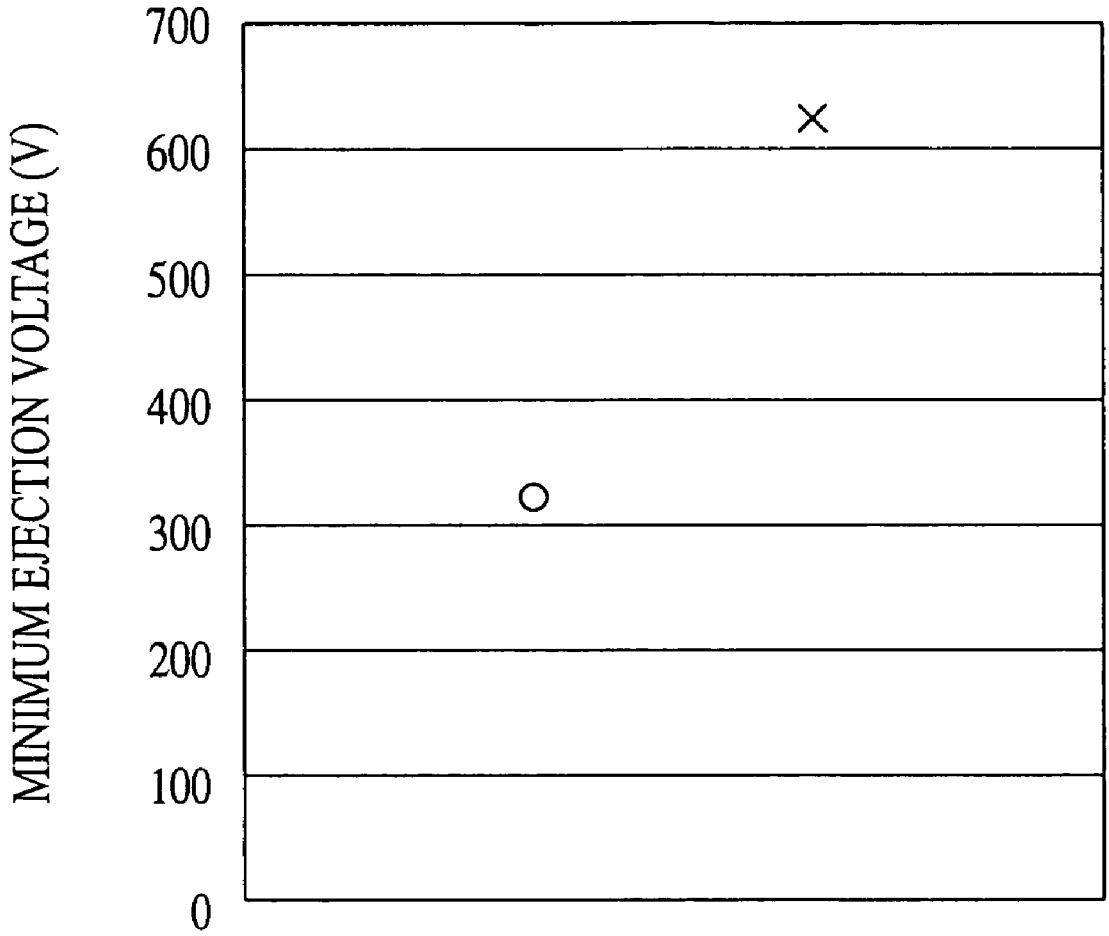
FIG. 17 is a graph showing the minimum voltage required for ejection when a pulse voltage is applied to the ejection electrode and when a bias voltage is applied to the ejection electrode.

FIG. 17 is a diagram showing respective minimum voltages necessary for ejection in the aforementioned liquid ejection apparatus shown in FIG. 7 in the case of applying a pulse voltage to the ejection electrode, and in the case of applying a bias voltage that is a DC constant voltage applied for a certain period, the apparatus using the pressure generator as a convex meniscus generator for applying an ejection air pressure to a nozzle. Here, insulating body is used for the substrate K as an object to be ejected. In FIG. 17, ○ indicates the result obtained for application of the pulse voltage, and X indicates the result obtained for application of the bias voltage.

When ejecting on the insulating body, influence due to charging-up on the surface of the insulating body tends to occur but it is observed from the diagram that the voltage necessary for ejection can be reduced since the application period of the pulse voltage is shorter than the bias voltage.

(Test [2] for Evaluating Effect of Pulse Voltage as Ejection Voltage)

FIG. 18 is a table showing a result of comparison test in the aforementioned liquid ejection apparatus shown in FIG. 7 in the case of applying a pulse voltage to the ejection electrode and in the case of applying a bias voltage that is a DC constant voltage applied for a certain period, the apparatus using the pressure generator as a convex meniscus generator for applying an ejection air pressure to a nozzle, with observation result for small-diameter nozzles and influence on electro-wetting produced at the top-end surface of the nozzle.

Inner diameters of the nozzle used in this comparison test were 30, 10 and 1 μm, and the solution was triethylene glycol. The pulse voltage and the bias voltage were both 1000 V.

When the bias voltage was applied, spreading (oozing) of solution meniscus at the nozzle top portion due to electro-wetting occurred with the nozzle diameter of 10 μm or less.

On the other hand, it was observed that, when the pulse voltage was applied, spreading of solution meniscus at the nozzle top portion due to electro-wetting did not occur even with the nozzle diameter of 1 μm because voltage-application time is shorter.

(Test [3] for Evaluating Effect of Pulse Voltage as Ejection Voltage)

FIG. 19 is a table showing a result of comparison test in the aforementioned liquid ejection apparatus shown in FIG. 7 in the case of applying a pulse voltage to the ejection electrode and in the case of applying a bias voltage that is a DC constant voltage applied for a certain period, the apparatus using the pressure generator as a convex meniscus generator for applying an ejection air pressure to a nozzle, with observation result for small-diameter nozzles and influence on clogging that occur at the top portion of the nozzle.

Inner diameters of the nozzle used in this comparison test were 30, 10 and 1 μm, and the solution was metal paste.

The pulse voltage and the bias voltage were both 1000 V.

When the bias voltage was applied, clogging occurred at the nozzle with the nozzle diameter of 10 μm or less. On the other hand, it was observed that, when the pulse voltage was applied, clogging did not occur even with the nozzle diameter of 1 μm since voltage-application time is shorer.

INDUSTRIAL APPLICABILITY

As described above, the liquid ejection apparatus according to the present invention is suitable for ejection of liquid corresponding to each of the various uses: in graphic use such as normal printing, printing on a special medium (film, cloth, metal plate, etc.), wiring with liquid or paste-like conductive material, application for patterning antenna and the like; in treatment use such as application of adhesive, sealer, etc.; in biological and medical use such as application of medicine (as in case of combining plural minute quantity of ingredients), sample for diagnosing gene, and the like.

EXPLANATION OF REFERENCE NUMERAL

20 liquid ejection apparatus
21 nozzle
25 ejection voltage supply
26 liquid ejection head
40 convex meniscus generator
50 operation controller
K substrate

The invention claimed is:

1. An electrostatic attraction type liquid ejection apparatus comprising:

an opposing electrode;

a liquid ejection head having: (i) plural nozzles arranged on a same plane facing a same direction so as to face the opposing electrode, each of the nozzles having an inner diameter of at most 15 μm, (ii) a flexible base layer, (iii) an insulating layer formed over an entire surface of the flexible base layer, (iv) a flow channel layer which has a solution chamber and a supply channel for each of the nozzles, and which is positioned over the insulating layer for forming the supply channels of a solution, (v) a nozzle plate which has the nozzles and which is formed over the flow channel layer, and (vi) an ejection electrode which is arranged at an entire boundary between the flow channel layer and the nozzle plate;

an ejection voltage supply to apply an ejection voltage to the solution inside the nozzles via the ejection electrode so as to charge the solution in the solution chambers, the ejection voltage supply including the ejection electrode which contacts with the solution to charge the solution;

a convex meniscus generator: (i) which has a piezoelectric transducer and a drive voltage supply for applying a drive voltage to the piezoelectric transducer to deform the piezoelectric transducer, and (ii) which is provided for each of the nozzles, to cause the solution inside each of the nozzles to rise therefrom in a convex shape; and an operation controller to control application of the drive voltage to drive each convex meniscus generator and application of the ejection voltage by the ejection voltage supply so that the drive voltage to each convex meniscus generator is applied in a timing corresponding to the application of a pulse voltage as the ejection voltage by the ejection voltage supply;

wherein the operation controller controls the ejection voltage supply to apply a voltage which has a reversed polarity to the ejection voltage to be applied by the ejection electrode, and which is applied to the solution inside each of the nozzles via the ejection electrode just before or just after the ejection voltage is applied to the solution inside each of the nozzles.

2. The electrostatic attraction type liquid ejection apparatus of claim 1, wherein the operation controller applies the drive voltage to each convex meniscus generator in advance, and also in the timing corresponding to the application of the pulse voltage as the ejection voltage by the ejection voltage supply.

3. The electrostatic attraction type liquid ejection apparatus of claim 1, wherein the inner diameter of each of the nozzles is between 0.2 μm and 8 μm.

4. The electrostatic attraction type liquid ejection apparatus of claim 1, wherein the opposing electrode has an opposing surface which faces top portions of the plurality of nozzles and which supports a substrate.

5. The electrostatic attraction type liquid ejection apparatus of claim 1, wherein the ejection voltage supply is provided in common for the plurality of nozzles so as to apply the ejection voltage to the solution inside each of the plurality of nozzles.

6. The electrostatic attraction type liquid ejection apparatus of claim 1, wherein the liquid ejection apparatus is provided in an ink jet printer.

7. The electrostatic attraction type liquid ejection apparatus of claim 1, wherein the inner diameter of each of the nozzles is uniform through a length thereof.

8. The electrostatic attraction type liquid ejection apparatus of claim 1, wherein the inner diameter of each of the nozzles is tapered.

9. The electrostatic attraction type liquid ejection apparatus of claim 1, wherein each of the nozzles has a substantially conical shape.

10. The electrostatic attraction type liquid ejection apparatus of claim 1, wherein each of the nozzles has a height of approximately 100 μm.

11. The electrostatic attraction type liquid ejection apparatus of claim 3, wherein the inner diameter of each of the nozzles is between 0.2 μm and 4 μm.

12. The electrostatic attraction type liquid ejection apparatus of claim 4, wherein the opposing electrode is provided in common for the plurality of nozzles so as to face the top portions of the plurality of nozzles.

13. The electrostatic attraction type liquid ejection apparatus of claim 8, wherein the inner diameter of each of the nozzles is larger at a solution-chamber side and gradually decreases toward an ejection-opening side.

* * * * *